US009325089B2

(12) United States Patent
Ito

(10) Patent No.: US 9,325,089 B2
(45) Date of Patent: Apr. 26, 2016

(54) CONNECTING STRUCTURE AND CONNECTING METHOD OF FLAT CIRCUIT BODY AND TERMINAL

(71) Applicant: Yazaki Corporation, Minato-ku, Tokyo (JP)

(72) Inventor: Naoki Ito, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/333,993

(22) Filed: Jul. 17, 2014

(65) Prior Publication Data

US 2014/0329394 A1 Nov. 6, 2014

Related U.S. Application Data

(63) Continuation of application No. PCT/JP2013/051359, filed on Jan. 17, 2013.

(30) Foreign Application Priority Data

Jan. 18, 2012 (JP) ..... 2012-008072

(51) Int. Cl.
*H01R 4/24* (2006.01)
*H01R 12/70* (2011.01)
(Continued)

(52) U.S. Cl.
CPC ..... *H01R 12/70* (2013.01); *H01R 4/182* (2013.01); *H01R 4/20* (2013.01); *H01R 12/69* (2013.01); *H01R 43/048* (2013.01)

(58) Field of Classification Search
CPC ..... H01R 4/2495; H01R 4/182; H01R 12/68; H05K 3/326; H05K 1/118
USPC ..... 439/422, 423, 424, 425, 81
See application file for complete search history.

(56) References Cited

U.S. PATENT DOCUMENTS 2,302,767 A * 11/1942 Hackbarth ..... 439/423
3,395,381 A * 7/1968 Huffnagle ..... 439/422
(Continued)

FOREIGN PATENT DOCUMENTS

CN 1360369 A 7/2002
CN 1591979 A 3/2005
(Continued)

OTHER PUBLICATIONS

Search Report and Written Opinion issued in corresponding International Application No. PCT/JP2013/051359 mailed Mar. 18, 2013.
(Continued)

*Primary Examiner* — Abdullah Riyami
*Assistant Examiner* — Vladimir Imas
(74) *Attorney, Agent, or Firm* — Banner & Witcoff, Ltd.

(57) ABSTRACT

A portion of a flat conductor of a flat circuit board is exposed from an insulating layer covering at least one of surfaces of the flat conductor. A terminal includes a bottom plate on which the exposed portion of the flat conductor is provided, and crimp claws which are raised at two side edges of the bottom plate so that the exposed portion of the flat conductor is disposed therebetween. A spacer member is provided on the exposed portion of the flat conductor, and is configured to be plastically deformed so as to contact with inner surfaces of the crimp claws when the crimp claws are crimped onto the spacer member, thereby the terminal is crimped to the flat conductor in a state where the exposed portion of the flat conductor is in surface contact with the bottom plate.

4 Claims, 31 Drawing Sheets

(51) Int. Cl.

| | |
|---|---|
| ***H01R 4/18*** | (2006.01) |
| ***H01R 4/20*** | (2006.01) |
| ***H01R 12/69*** | (2011.01) |
| ***H01R 43/048*** | (2006.01) |

(56) References Cited

U.S. PATENT DOCUMENTS

| | | | | |
|---|---|---|---|---|
| 3,715,457 | A * | 2/1973 | Teagno et al. | 174/88 R |
| 3,924,917 | A * | 12/1975 | Munshower | 439/422 |
| 4,082,402 | A * | 4/1978 | Kinkaid et al. | 439/422 |
| 4,258,974 | A * | 3/1981 | Kuo et al. | 439/412 |
| 4,315,662 | A * | 2/1982 | Greenwood et al. | 439/48 |
| 5,137,468 | A * | 8/1992 | Murakami | 439/422 |
| 6,068,505 | A | 5/2000 | Sai | |
| 6,135,579 | A * | 10/2000 | Beck | 303/116.1 |
| 6,135,779 | A | 10/2000 | Koch et al. | |
| 6,375,492 | B1 | 4/2002 | Hio | |
| 6,461,188 | B2 * | 10/2002 | Reul | 439/422 |
| 6,467,164 | B2 | 10/2002 | Aoyama | |
| 6,524,143 | B2 | 2/2003 | Chen | |
| 6,604,958 | B2 * | 8/2003 | Watanabe | 439/425 |
| 7,306,495 | B2 | 12/2007 | Hashimoto et al. | |
| 7,316,581 | B2 * | 1/2008 | Kumakura | 439/422 |
| 7,410,384 | B2 * | 8/2008 | Shuey | 439/422 |
| 7,462,062 | B2 * | 12/2008 | Kumakura | 439/422 |
| 7,513,792 | B2 * | 4/2009 | Kumakura | 439/422 |
| 7,581,979 | B2 * | 9/2009 | Kumakura | 439/422 |
| 2001/0027052 | A1 | 10/2001 | Aoyama | |
| 2002/0077001 | A1 | 6/2002 | Chen | |
| 2005/0026515 | A1 | 2/2005 | Hashimoto et al. | |
| 2005/0227550 | A1 | 10/2005 | Takayama | |
| 2007/0111613 | A1 * | 5/2007 | Kumakura | 439/851 |

FOREIGN PATENT DOCUMENTS

| | | | |
|---|---|---|---|
| DE | 199 04 277 | A1 | 8/1999 |
| EP | 0 926 764 | A2 | 6/1999 |
| EP | 1139 492 | A2 | 10/2001 |
| JP | S55-120081 | | 9/1980 |
| JP | H09-134743 | A | 5/1997 |
| JP | H10-125439 | A | 5/1998 |
| JP | 2000-077124 | A | 3/2000 |
| JP | 2006-107874 | A | 4/2006 |

OTHER PUBLICATIONS

Jul. 14, 2015—(JP) Notification of Reasons for Refusal—App 2012-008072, Eng Trans.

Oct. 12, 2015—(KR) Office Action—App 10-2014-7019751, Eng Tran.

Oct. 8, 2015—(CN) Notification of the First Office Action—App 201380005886.2, Eng Iran.

* cited by examiner

CONNECTING STRUCTURE AND CONNECTING METHOD OF FLAT CIRCUIT BODY AND TERMINAL

CROSS REFERENCE TO RELATED APPLICATIONS

This application is a continuation of PCT application No. PCT/JP2013/051359, which was filed on Jan. 17, 2013 based on Japanese Patent Application (No. 2012-008072) filed on Jan. 18, 2012, the contents of which are incorporated herein by reference.

BACKGROUND OF THE INVENTION

1. Field of the Invention

The present invention is related to a connecting structure and a connecting method of a flat circuit body and a terminal in which the terminal is crimped to connect to a flat conductor of the flat circuit body which is formed to a planar wiring member by covering at least one side of surfaces of a plurality of flat conductors, which are separated at a predetermined interval and arranged into a planar shape, with insulating layers.

2. Description of the Related Art

A wiring member which has flexibility such as an FPC (that is, Flexible Printed Circuit), an FFC (that is, Flexible Flat Cable) or a ribbon electric wire corresponds to the flat circuit body.

FIGS. 29 to 31 show a conventional example of a connecting method of a flat circuit body and a terminal. The connecting method of a flat circuit body and a terminal is disclosed in PTL 1.

A flat circuit body 110 used in the connecting method of PTL 1 includes a plurality of flat conductors 111 which are separated at a predetermined interval and arranged into a planar shape, and insulating layers 112 which cover the flat conductors 111, and is formed to a planar wiring member, as shown in FIG. 29.

A terminal 120 which is crimped to connect to the flat circuit body 110 is a press formed member which is made of a metal plate. The terminal 120 includes a bottom plate 121*a* on which the flat circuit body 110 is mounted and crimp claws 121*b* which are raised at two side edges of the bottom plate 121*a*, in a circuit body connecting part 121 which is crimped to connect to the flat conductors 111 of the flat circuit body 110, as shown in FIG. 29. The bottom plate 121*a* is formed into a belt shape whose width w2 is narrower than a width w1 of the flat conductors 112 in the flat circuit body 110. The distal end of the crimp claw 121*b* is formed into a pointed shape so that the flat conductor 111 of the flat circuit body 110 is penetrated to become a skewered state.

In the connecting method disclosed in the PTL 1, as shown in FIG. 30, the above-mentioned flat circuit body 110 is located between an anvil 131 and a crimper 132 which are placed to be opposed. A pressing plate 133 is placed on the top surface of the flat circuit body 110 which faces the crimper 132. In the pressing plate 133, claw through holes 133*b* are formed in a flat board-like plate body 133*a* which presses the top surface of the flat circuit body 110. The claw through holes 133*b* are through holes into which the crimp claws 121*b* of the terminal 120 supported on the anvil 131 can be inserted as shown in FIG. 30.

By pushing up the bottom plate 121*a* of the terminal 120 with the anvil 131 to insert the distal ends of the crimp claws 121*b* through the claw through holes 133*b* of the pressing plate 133, a state is reached that the crimp claws 121*b* penetrate through the insulating layer 112 and the flat conductor 111 of the flat circuit body 110. When the crimp claws 121*b* penetrate through the flat conductor 111, the crimp claws 121*b* and the flat conductor 111 are in a contact state, and the flat circuit body 110 and the terminal 120 are in an electrically connected state.

Then, as shown in FIG. 31, a state is reached that the pressing plate 133 is removed from the space between the flat circuit body 110 and the crimper 132. Then, by pushing the bottom plate 121*a* of the terminal 120 to the side of the crimper 132 with the anvil 131, the distal ends of the crimp claws 121*b* which penetrate through the flat circuit body 110 are pressed to curved recesses 132*a* for claw forming of the crimper 132. When the distal ends of the crimp claws 121*b* are pressed to the crimper 132*m* to be curved to the top surface side of the flat circuit body 110 so that the distal ends of the crimp claws 121*b* reach a state of being cut into the top surface of the flat circuit body 110, the crimping of the crimp claws 121*b* is completed.

By completing the crimping of the crimp claws 121*b*, the terminal 120 is crimped to the flat conductor 111.

CITATION LIST

Patent Literature

[PTL 1] JP-A-2006-107874

SUMMARY OF THE INVENTION

In the connecting method in the PTL 1, the flat conductors 112 of the flat circuit body 110 are damaged due to the penetration of the crimp claws 121*b*, and when a pulling load is acted on the flat circuit body 110, the damages expand, and electrical connection performance may decrease due to the increase of contact resistance with the expansion of the damages.

Further, in the connecting method in the PTL 1, the distal ends of the crimp claws 121*b* are pressed to the curved recesses 132*a* of the crimper 132 to be formed into a curved form or curl form to cut into the top surface of the flat circuit body 110. At this time, in order to control a crimping pressure or precisely control the height of the crimp claws 121*b* after being shaped so that the distal ends of the crimp claws 122*b* will not excessively damage the flat conductors 112, force increasing or decreasing which is difficult in a crimping operation is required, and there is a problem that operativity is difficult to be improved.

It is therefore one advantageous aspect of the present invention to provide a connecting structure and a connecting method of a flat circuit body and a terminal so that the electrical connection performance does not decrease because the flat conductors of the flat circuit body are damaged by a pulling load that is acted on the flat circuit body, and a stable electrical connection performance can be easily secured without requiring the force increasing or decreasing which is difficult in a crimping operation of the terminal.

According to one advantage of the invention, there is provided a connecting structure of a flat circuit body and a terminal, comprising:

a flat circuit body including a flat conductor and an insulating layer covering at least one of surfaces of the flat conductor, a portion of the flat conductor being exposed from the insulating layer;

a terminal including a bottom plate on which the exposed portion of the flat conductor is provided, and crimp claws which are raised at two side edges of the bottom plate so that the exposed portion of the flat conductor is disposed therebetween; and a spacer member, provided on the exposed portion of the flat conductor, and configured to be plastically deformed so as to contact with inner surfaces of the crimp claws when the crimp claws are crimped onto the spacer member, thereby the terminal is crimped to the flat conductor in a state where the exposed portion of the flat conductor is in surface contact with the bottom plate.

The flat circuit body may include a plurality of flat conductors which are arranged in a planar shape with separated at a predetermined interval.

The connecting structure may be configured such that: the spacer member includes a conductor pressing part which is provided on the exposed portion of the flat conductor and a projected parts which are projected from two side edges of the conductor pressing part, and the projected parts are covered by the crimp claws and are plastically deformed so as to contact with the inner surfaces of the crimp claws, when the crimp claws are crimped onto the spacer member.

The spacer member may have a tube shape.

According to the present invention, the crimp claws of the terminal are crimped to the spacer member which is overlaid on the conductor exposed portion of the flat circuit body, and by pressing the spacer member to the side of the bottom plate of the terminal, to make the flat conductor in the conductor exposed portion to be in a surface contact state with the bottom plate of the terminal, a crimped state of the flat conductor of the flat circuit body and the terminal is reached. That is, the crimp claws of the terminal will not penetrate through the flat conductor of the flat circuit body, and since the distal ends of the claws do not cut into the flat conductor, the crimp claws will not damage the flat conductor.

Therefore, even if a pulling load is applied on the flat circuit body, the damage will not expand in the flat conductor as conventionally, and there is no fear that electrical connection performance decreases due to the increase of contact resistance with the expansion of the damage in the flat conductor.

In addition, since the crimp claws do not directly contact with the conductor exposed portion, the force increasing or decreasing which is difficult in a crimping operation of the terminal is not required. Therefore, the crimping operation can be performed easily.

Therefore, a stable electrical connection performance can be easily secured.

According to the invention, when a crimper which makes the crimp claws to be curved from the distal end side to make the distal ends of the crimp claws abut on the top surface of the spacer member is used as a means for crimping the crimp claws to the spacer member, the projected parts which are deformed plastically to a shape corresponding to the shape of the inner surfaces of the crimp claws by a pressure applied from the crimp claws are buried in spaces which the curved crimp claws form.

In other words, the crimp claws contact with the projected parts without a gap so that the spacer member is pressed and fixed tightly by the crimp claws. Thus, because the pressing force applied from the crimp claws to the projected parts is acted on the board-like conductor pressing part, roughly the whole area of the flat conductor reaches a surface contact state with the bottom plate roughly equally. Therefore, an enough contact area, where the contact pressure between the terminal and the flat conductor is stabilized, is secured so that a reliable electrical connection performance can be obtained. The board-like conductor pressing part may be a flat board-like one or may be a curved board-like one.

According to the invention, since the spacer member is a tube-like member, a spacer can be made easily and cheaply.

According to the invention, there is no fear that the electrical connection performance decreases when the flat conductor of the flat circuit body is damaged by a pulling load applied on the flat circuit body, and the force increasing or decreasing which is difficult in a crimping operation of the terminal is not required so that a stable electrical connection performance can be easily secured.

According to the crimp connecting structure and the crimp connecting method of the terminal and the flat circuit body of the present invention, the crimp claws of the terminal are crimped to the spacer member which is overlaid on the conductor exposed portion of the flat circuit body, and by pressing the spacer member to the side of the bottom plate of the terminal, to make the flat conductor in the conductor exposed portion to be in a surface contact with the bottom plate of the terminal, a crimped state of the flat conductor of the flat circuit body and the terminal is reached. That is, the crimp claws of the terminal will not penetrate through the flat conductor of the flat circuit body, and since the distal ends of the claws do not cut into the flat conductor, the crimp claws will not damage the flat conductor.

Therefore, even if a pulling load is acted on the flat circuit body, the damage will not expand in the flat conductor as conventionally, and there is no fear that electrical connection performance decreases due to the increase of contact resistance with the expansion of the damage in the flat conductor.

In addition, in the construction that the crimp claws press the flat conductor of the conductor exposed portion to the bottom plate of the terminal through the spacer member, since the crimp claws do not directly contact with the conductor exposed portion, the force increasing or decreasing which is difficult in a crimping operation of the terminal is not required. Therefore, the crimping operation can be performed easily.

Therefore, a stable electrical connection performance can be easily secured.

DETAILED DESCRIPTION OF THE EXEMPLARY EMBODIMENTS

Figure 1:
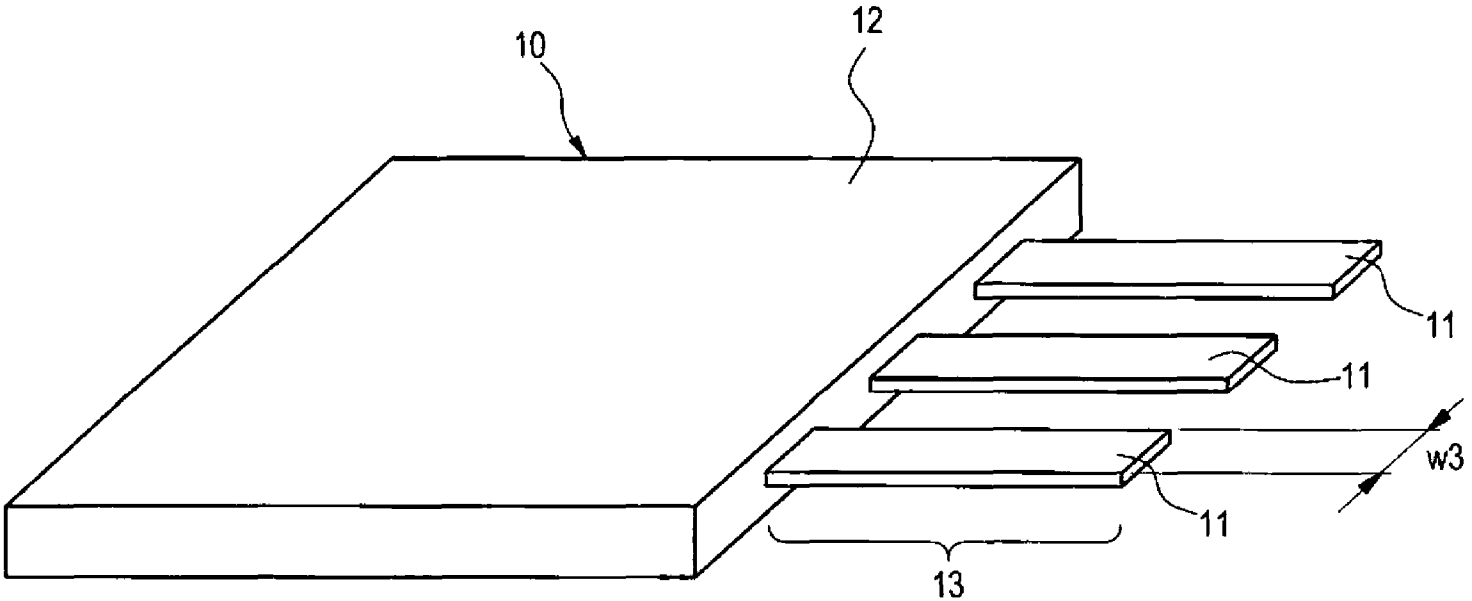
FIG. 1 is a perspective view of a flat circuit body used in a connecting structure of the flat circuit body and a terminal according to a first embodiment of the present invention.
Figure 2:
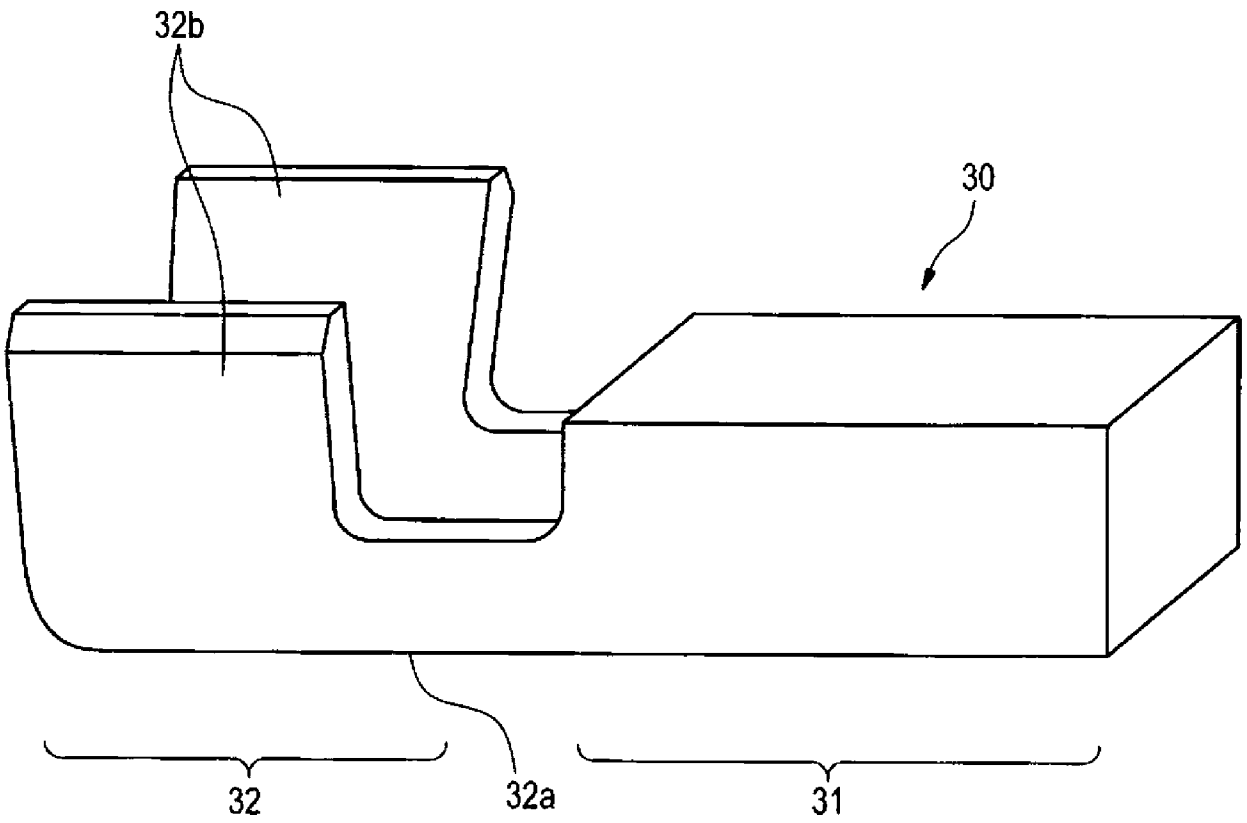
FIG. 2 is a perspective view of a terminal which is crimped to connect to a conductor exposed portion shown in FIG. 1.
Figure 3:
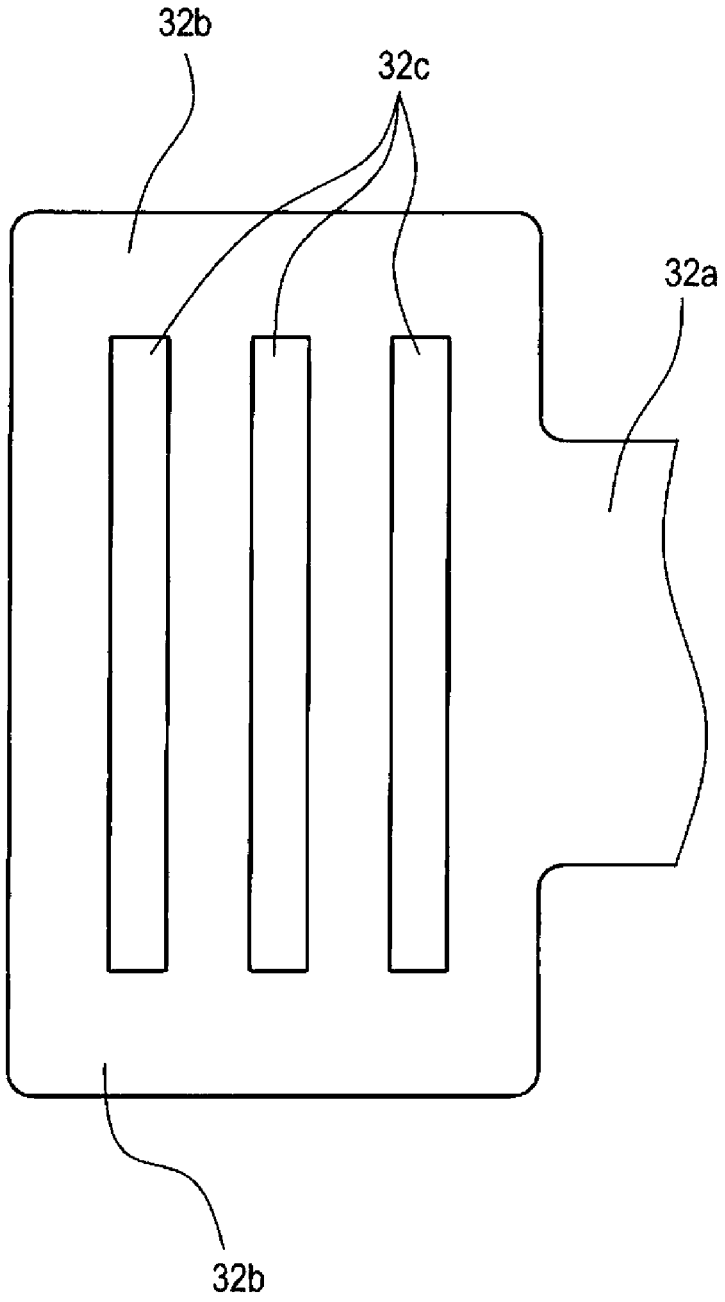
FIG. 3 is an expanded view of a circuit body connecting part of the terminal of FIG. 2.
Figure 4:
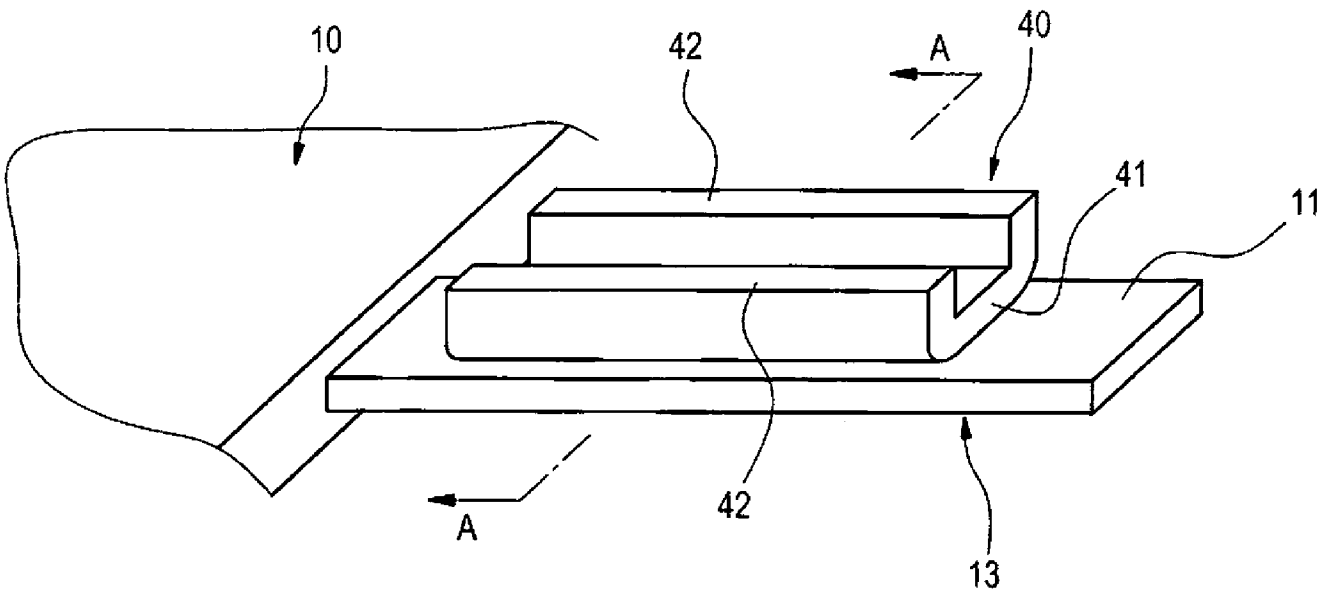
FIG. 4 is a perspective view which shows a state that a spacer member is mounted on the conductor exposed portion shown in FIG. 1.
Figure 5:
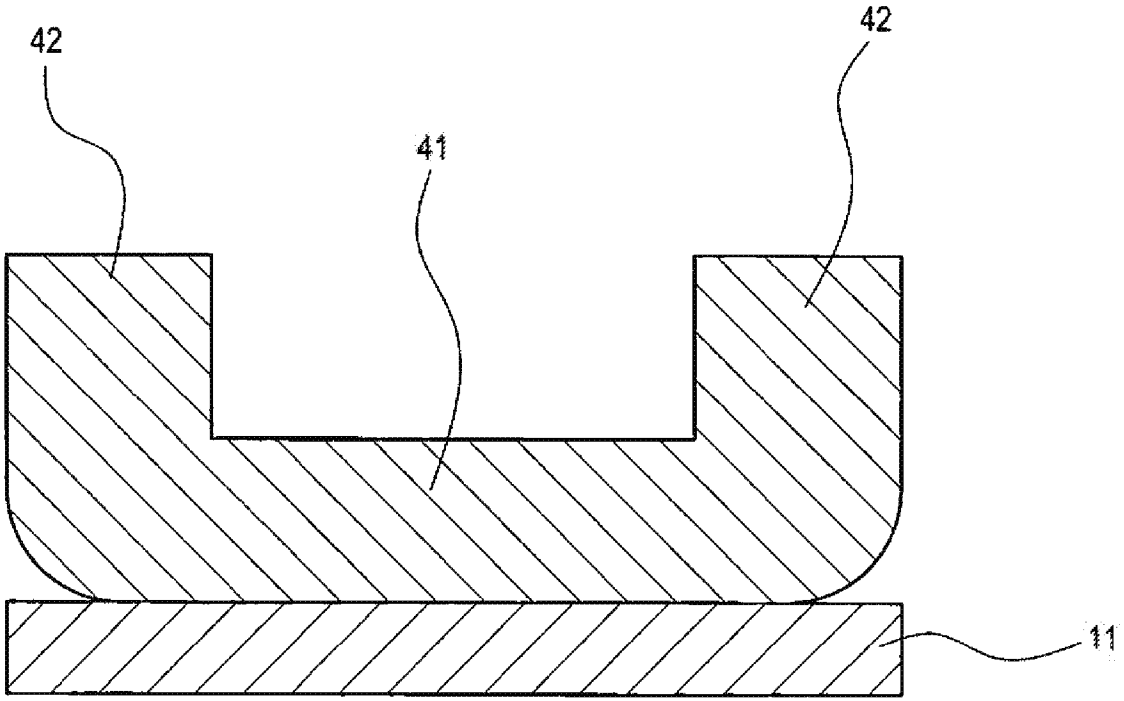
FIG. 5 is an A-A sectional view of FIG. 4.
Figure 6:
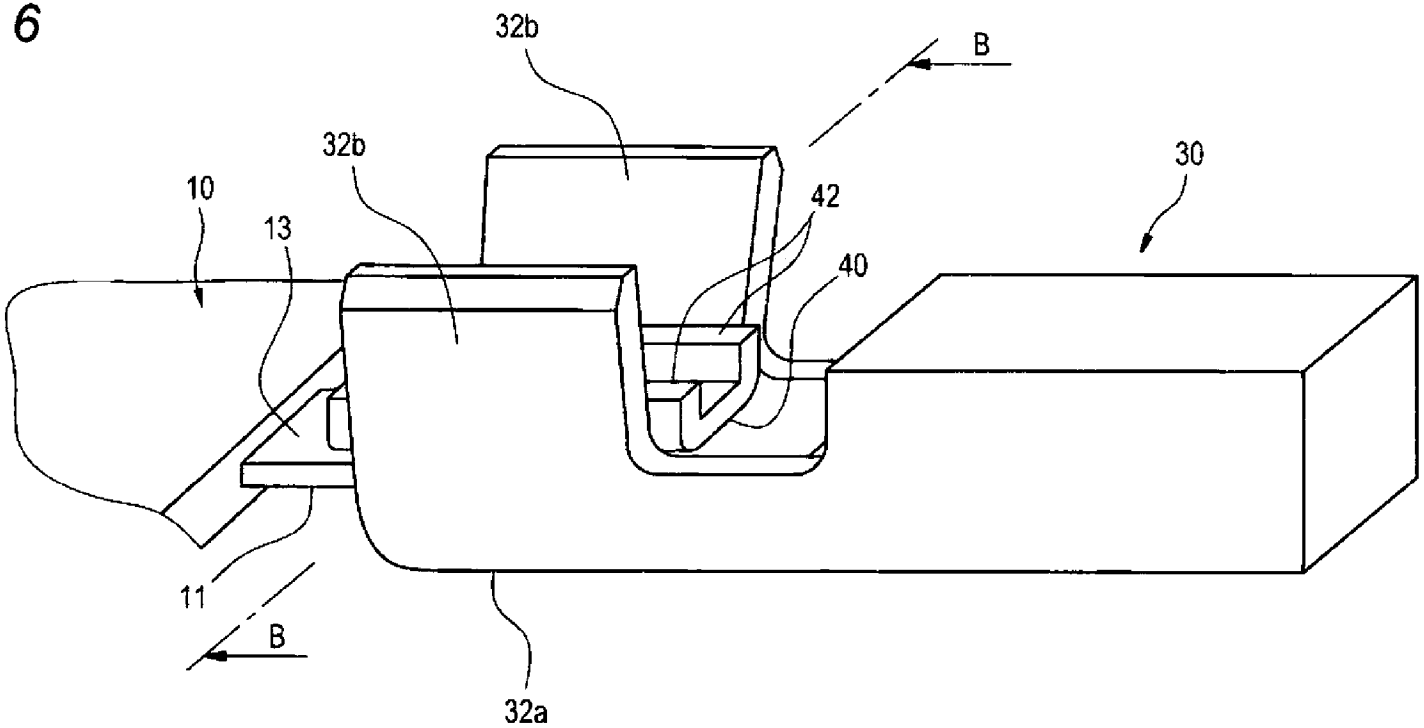
FIG. 6 is a perspective view which shows a state that the conductor exposed portion and the spacer member of FIG. 4 are mounted on a bottom plate of the terminal of FIG. 2.
Figure 7:
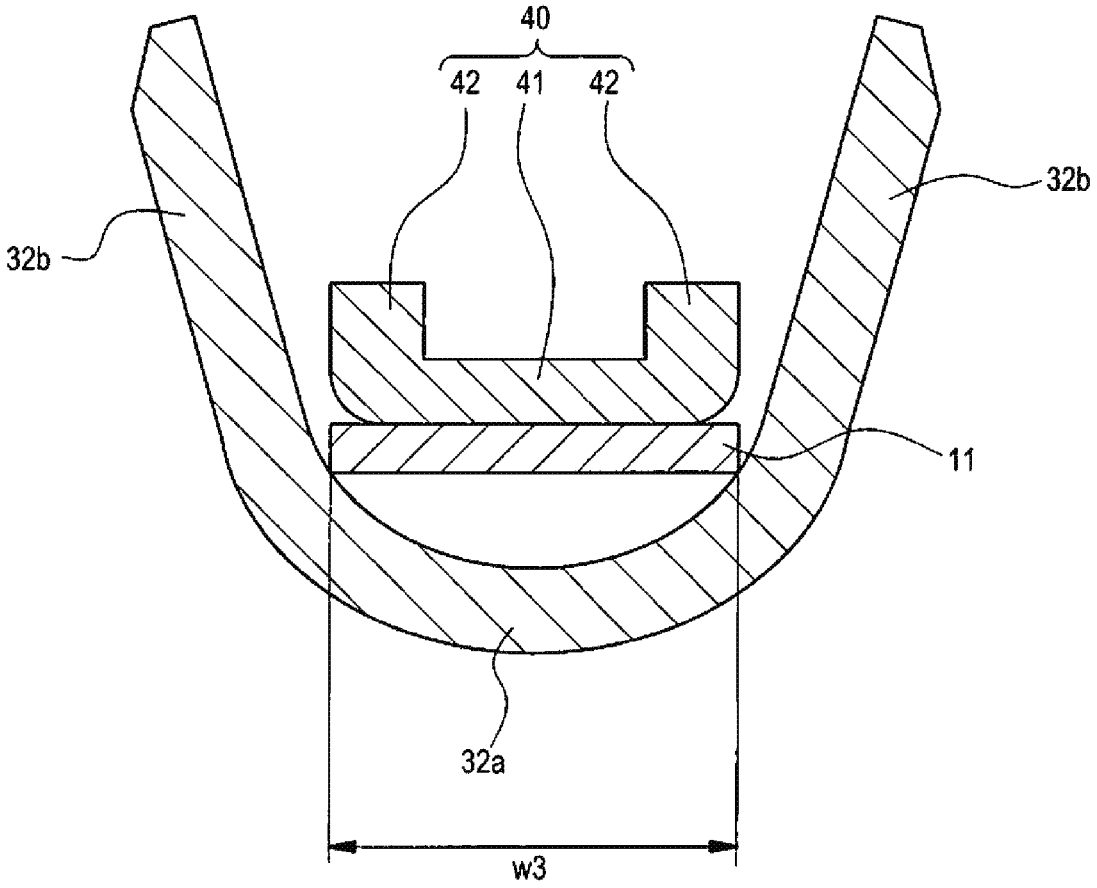
FIG. 7 is a B-B sectional view of FIG. 6.
Figure 8:
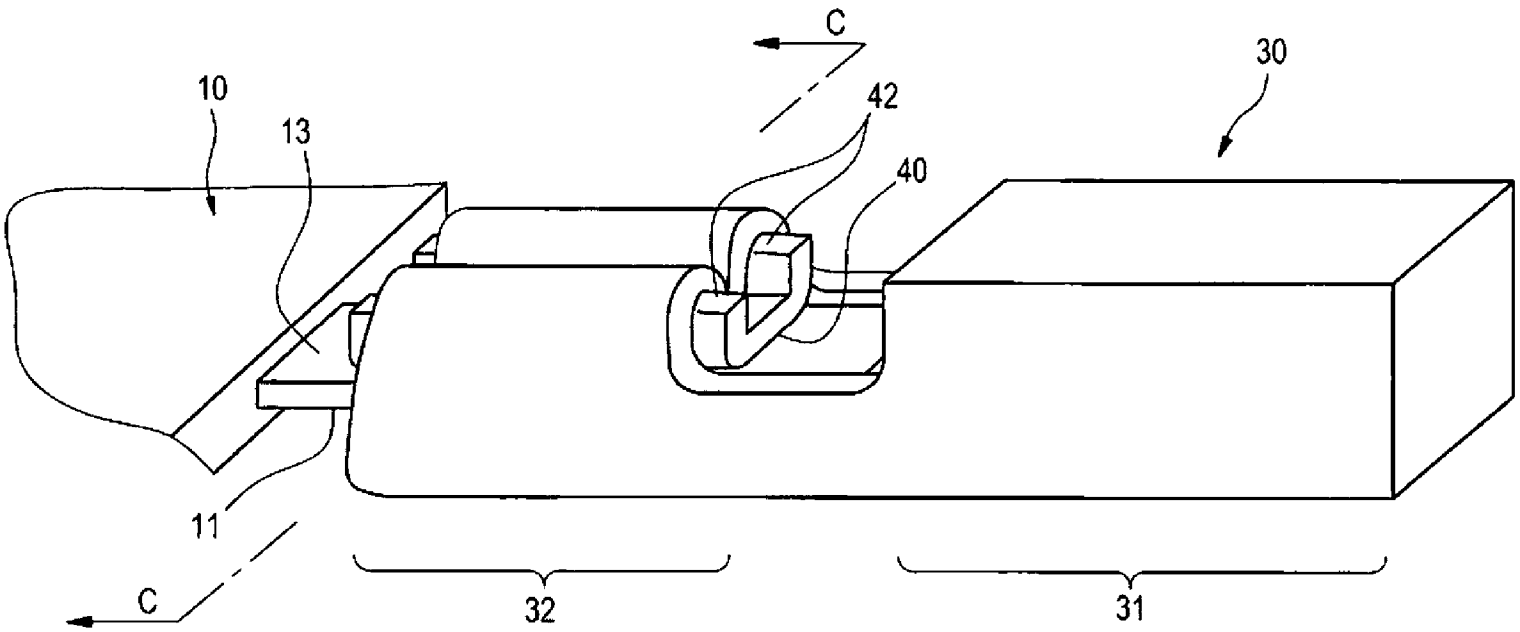
FIG. 8 is a perspective view which shows a completed connection state that crimp claws are crimped onto the spacer member from the state shown in FIG. 6.
Figure 9:
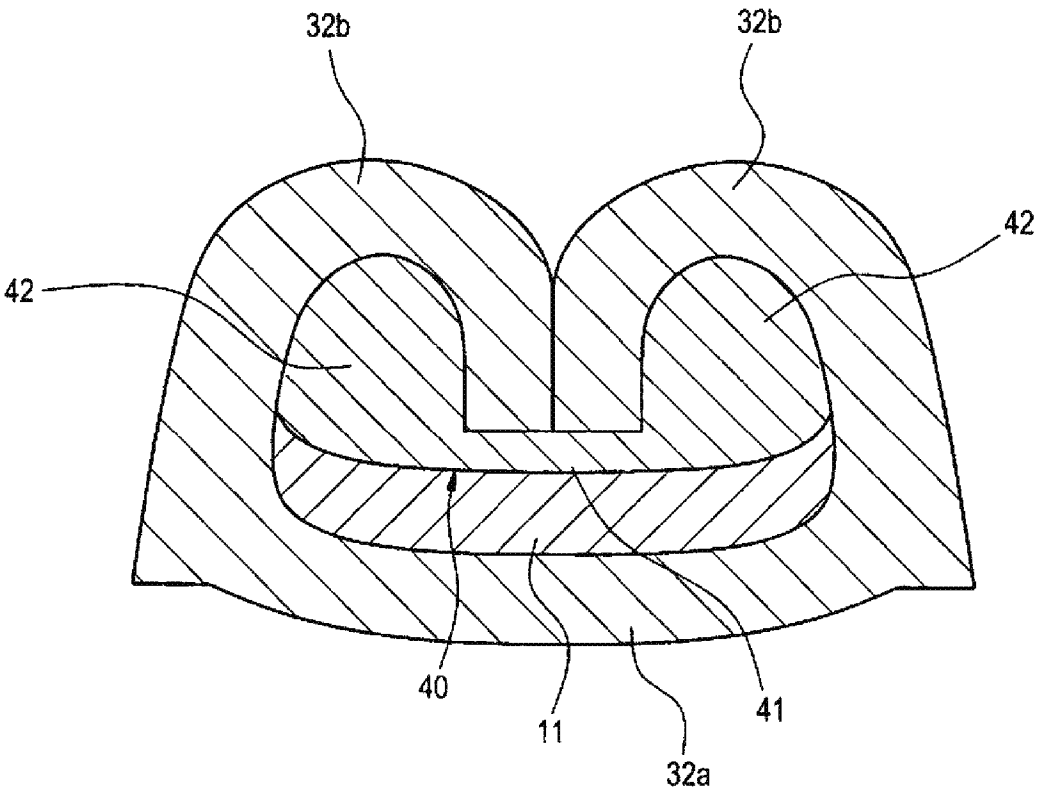
FIG. 9 is a C-C sectional view of FIG. 8.

FIGS. 1 to 9 show a first embodiment of a connecting structure and a connecting method of a flat circuit body and a terminal according to the present invention. FIG. 1 is a perspective view of the flat circuit body used in the embodiment of the present invention. FIG. 2 is a perspective view of the terminal which is crimped to connect to a conductor exposed portion shown in FIG. 1. FIG. 3 is an expanded view of a circuit body connecting part of the terminal of FIG. 2. FIG. 4 is a perspective view which shows a state that a spacer member is mounted on the conductor exposed portion shown in FIG. 1. FIG. 5 is an A-A sectional view of FIG. 4. FIG. 6 is a perspective view which shows a state that the conductor exposed portion and the spacer member of FIG. 4 are mounted on a bottom plate of the terminal of FIG. 2. FIG. 7 is a B-B sectional view of FIG. 6. FIG. 8 is a perspective view which shows a completed connection state that crimp claws are crimped onto the spacer member from the state shown in FIG. 6. FIG. 9 is a C-C sectional view of FIG. 8.

Figure 10:
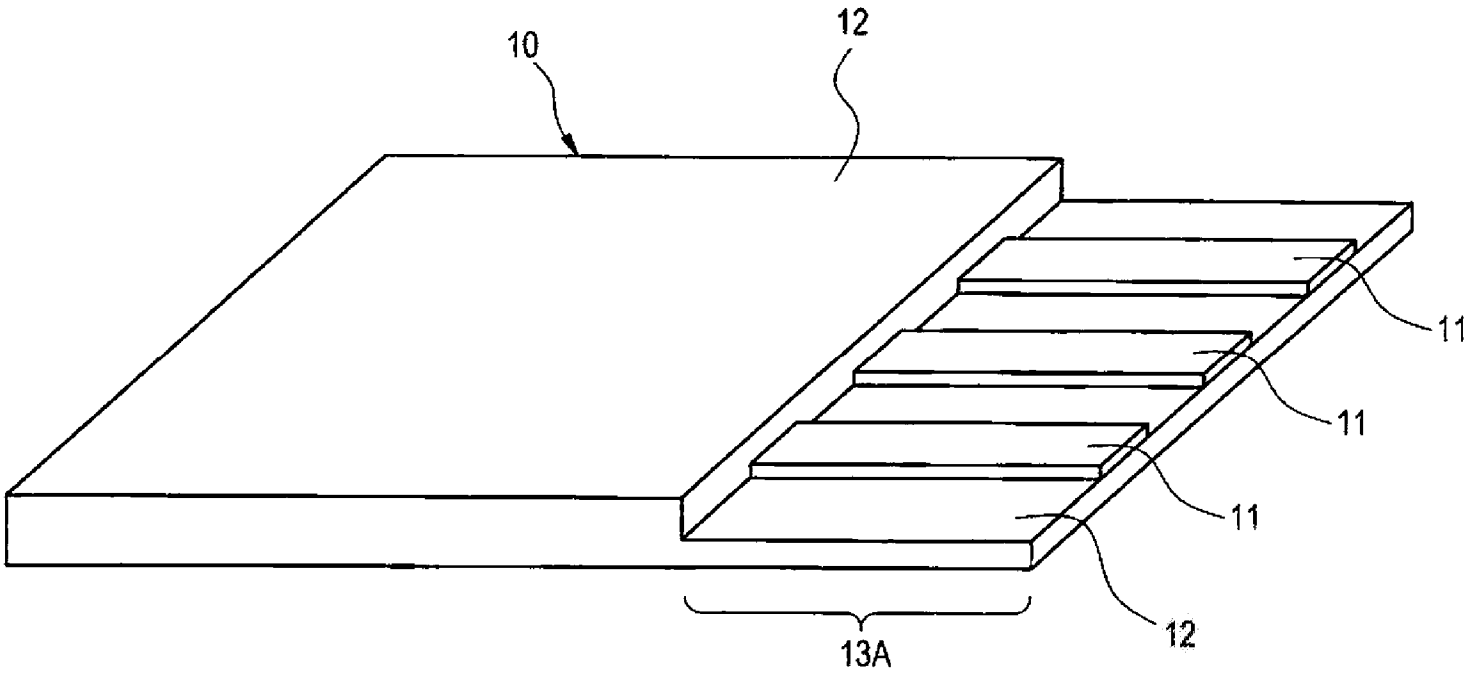
FIG. 10 is a perspective view of a flat circuit body used in a connecting structure of the flat circuit body and a terminal according to a second embodiment of the invention.

A flat circuit body 10 of FIG. 10 is formed to a planar wiring member by covering a plurality of flat conductors 11, which are separated at a predetermined interval and arranged into a planar shape, with insulating layers 12. In particular, a wiring member which has flexibility such as an FPC (Flexible Printed Circuit), an FFC (Flexible Flat Cable) or a ribbon electric wire corresponds to the flat circuit body 10. The flat circuit body 10 corresponds to, for example, a flat circuit body in which surfaces at both sides of the flat conductors 11 are covered with insulating layers 12, and the flat conductors 11 are exposed by stripping a part of the insulating layers 12 of the surfaces at one side, a flat circuit body in which surfaces at one side of the flat conductors 11 are covered with insulating layers 12 and the other surfaces are exposed, or a flat circuit body in which surfaces at one side of the flat conductors 11 are covered with insulating layers 12, and a part of the surfaces at the other side are further covered with insulating layers 12.

In the present embodiment, a conductor exposed portion 13 shown in FIG. 1 is formed in the flat circuit body 10 beforehand. The conductor exposed portion 13 is a portion where the flat conductors 11 are exposed by stripping the insulating layers 12. In FIG. 1, the insulating layers 12 located between adjacent flat conductors 11 are removed and the insulating layers 12 covering the surfaces at two sides of the flat conductors 11 are stripped so that the conductors 11 reach a state of exposing the surfaces at both sides.

The conductor exposed portion 13 is mounted on a bottom plate 32*a* of a terminal 30 to be described later in a direction that the exposed flat conductor 11 faces the bottom plate 32*a*. Because both surfaces of the flat conductors 11 are exposed in the conductor exposed portion 13 of the present embodiment, it does not mind which one of the top surface and the bottom surface of the conductor exposed portion 13 faces the bottom plate 32*a*.

The terminal 30 which is crimped to connect to the flat circuit body 10 is a press formed article that is made of a metal plate, and as shown in FIG. 2, includes a generally square pipe-like terminal fitting part 31 with which a mating terminal is fitted and connected, and a circuit body connecting part 32 to connect the flat circuit body 10.

The circuit body connecting part 32 includes a bottom plate 32*a* on which the flat circuit body 10 is mounted, and crimp claws 32*b* which are raised at two side edges of the bottom plate 32*a*. The bottom plate 32*a* is adapted to be able to mount the flat conductor 11 having a width w3 (refer to FIGS. 1 and 7) in the flat circuit body 10 thereon. On the surface of the bottom plate 32*a* on which the conductor exposed portion 13 is mounted, as shown in FIG. 3, groove-like serrations 32*c* are formed.

Figure 30:
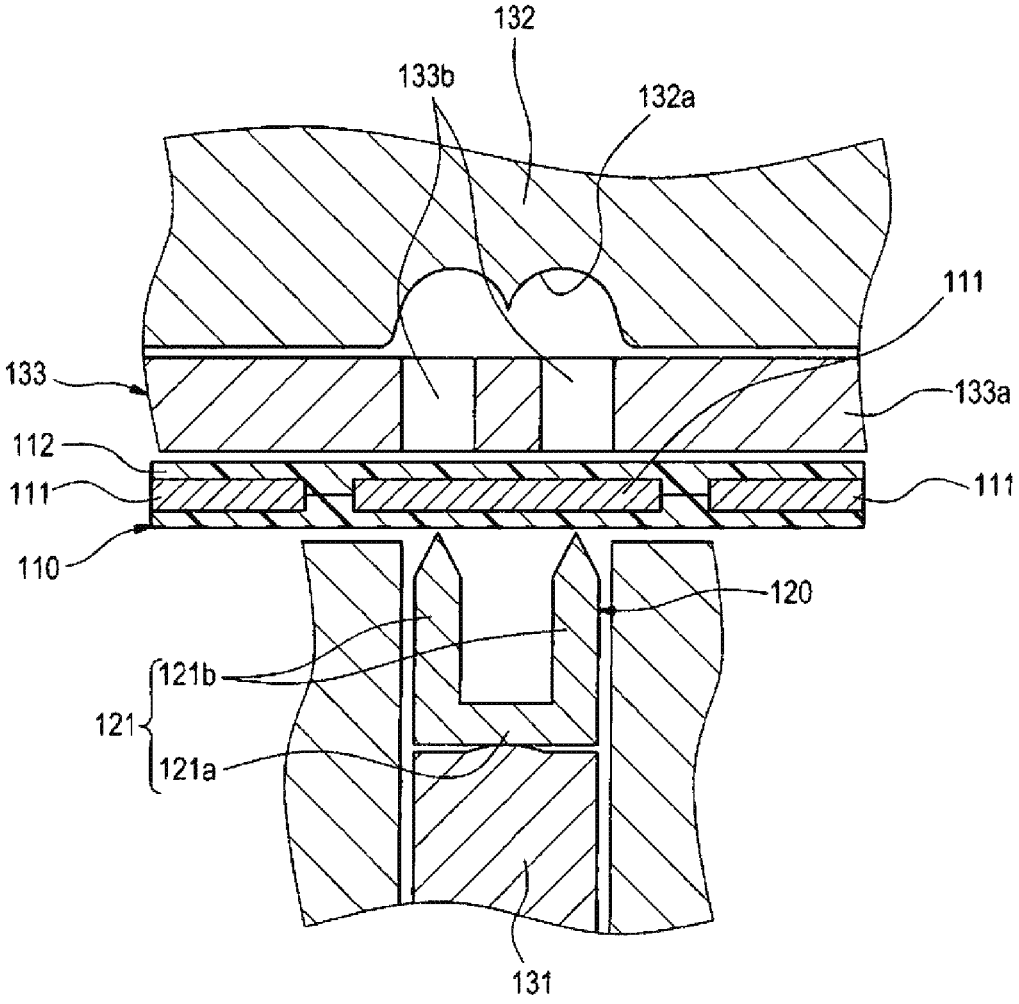
FIG. 30 is an illustrative figure of a connecting method of the flat circuit body and the terminal shown in FIG. 29, and is a cross sectional view which shows a state before crimp claws of the terminal penetrate the flat circuit body.
Figure 31:
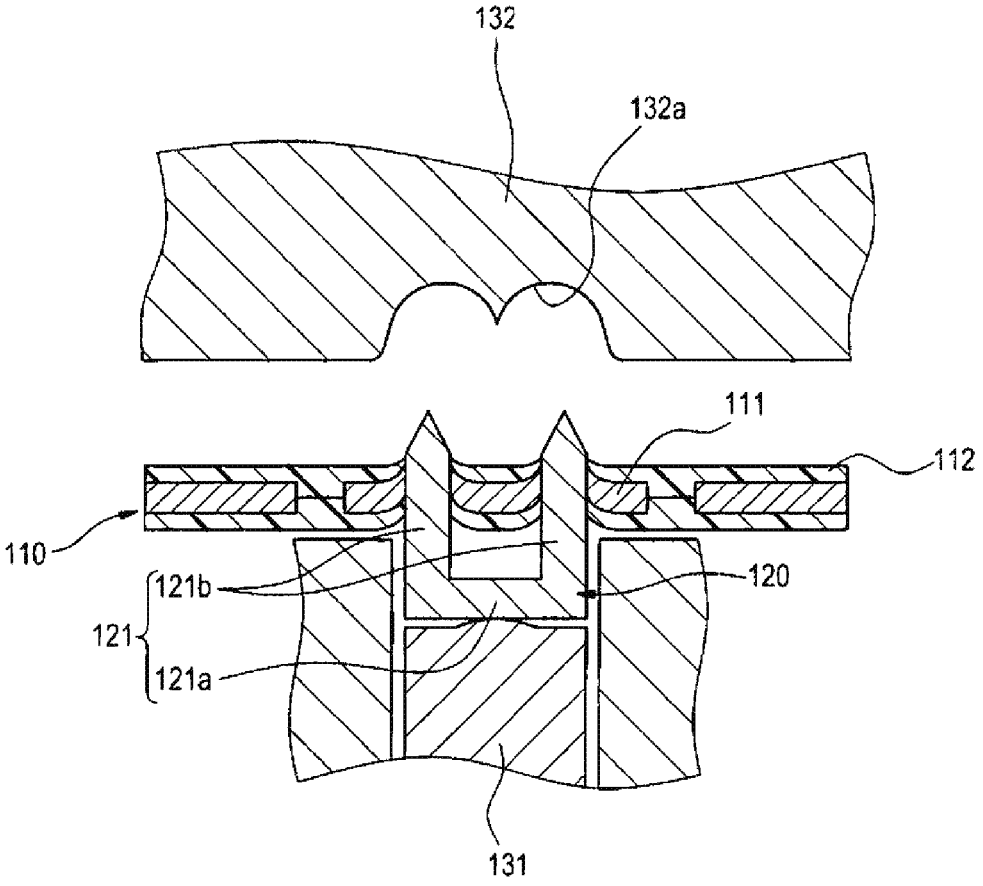
FIG. 31 is an illustrative figure of the connecting method of the flat circuit body and the terminal shown in FIG. 29, and is a cross sectional view which shows a state before the crimp claws of the terminal that penetrate the flat circuit body are crimped and formed by a crimper.

Each of the crimp claws 32*b* which extend from two side edges of the bottom plate 32*a* is a part that is crimped to a spacer member 40 to be described later which is mounted on the conductor exposed portion 13 which is mounted on the bottom plate 32*a*. In a crimping step of crimping and shaping the crimp claws 32*b*, a crimper that makes the crimp claws 32*b* to be curved from the distal end side of the crimp claws 32*b* to make the distal ends of the crimp claws 32*b* abut on the surface of the spacer member 40 is used, although the crimper is not shown in the figures. The crimper may be constructed like the crimper 132 of FIG. 30.

In the present embodiment, the spacer member 40 is mounted on the conductor exposed portion 13 which is mounted on the bottom plate 32*a*, as shown in FIGS. 4 and 5. The spacer member 40 includes a flat board-like conductor pressing part 41 which is overlaid on the flat conductor 11, and projected parts 42 which are formed to be projected from two side edges of the conductor pressing part 41 corresponding to positions that the crimp claws 32*b* cover, as shown in FIG. 5. The projected parts 42 are formed to be projected to extend along a length direction of the flat conductor 11.

The spacer member 40 is formed to be plastically deformable to such a shape that the space member 40 closely contact with the inner surfaces of the crimp claws 32*b* due to a pressure applied by the crimp claws 32*b*.

The material of the spacer member 40 may be a conductive material or an insulating material. However, the material of the spacer member 40 is chosen so that when the crimp claws 32*b* are crimped, as shown in FIG. 9, the projected part 42 are deformed plastically to such a shape that the projected parts 42 closely contact with the inner surfaces of the crimp claws 32*b* due to a pressure applied by the crimp claws 32*b*. The thickness of the conductor pressing part 41 is chosen as an appropriate value so that when the crimp claws 32*b* are crimped to the projected parts 42, the conductor pressing part 41 can be deformed into a shape so that the conductor pressing part 41 closely contacts with the bottom plate 32 due to a pressing load to the side of the bottom plate 32*a* which is applied from the projected parts 42 onto the conductor pressing part 41.

In the connecting structure of the present embodiment, first, as shown in FIGS. 6 and 7, the spacer member 40 is mounted on the conductor exposed portion 13 mounted on the bottom plate 32*a* in a direction that the flat conductor 11 exposed in the conductor exposed portion 13 meets the bottom plate 32*a*. As shown in FIGS. 8 and 9, by crimping the crimp claws 32*b* from above the spacer member 40, the spacer member 40 is deformed plastically into a shape to closely contact with the inner surfaces of the crimp claws 32*b* and the flat conductor 11 is made to closely contact with the bottom plate 32*a* in a surface contact state by a pressing force applied onto the flat conductor 11 through the spacer member 40 so that a crimped state of the flat conductor 11 and the terminal 30 is reached.

A connecting method to obtain the connecting structure of the present embodiment sequentially performs a conductor exposed portion forming step, a circuit body carrying step and a crimping step shown as follows.

In the conductor exposed portion forming step, as shown in FIG. 1, the conductor exposed portion 13 where the insulating layers 12 are stripped to expose the flat conductors 11 is formed in the flat circuit body 10. In a case where a flat circuit body 10 in which a part of the flat conductors 11 are exposed beforehand is used, the conductor exposed portion forming step may be omitted.

The circuit body mounting step is a step of mounting the conductor exposed portion 13 on the bottom plate 32*a* in a direction that the flat conductor 11 exposed in the conductor exposed portion 13 meets the bottom plate 32*a* of the terminal 30, as shown in FIGS. 6 and 7.

The crimping step is a step of crimping the crimp claws 32*b* at two side edges of the bottom plate 32*a* onto the spacer member 40 in a state that the above-mentioned spacer member 40 is overlaid on the conductor exposed portion 13 mounted on the bottom plate 32*a*, as shown in FIGS. 8 and 9. In the crimping step, the spacer member 40 is deformed plastically into a shape to closely contact with the inner surfaces of the crimp claws 32*b*, and the flat conductor 11 is made to closely contact with the bottom plate 32*a* in a surface contact state by a pressing force applied onto the flat conductor 11 through the spacer member 40 so that a crimped state of the flat conductor 11 and the terminal 30 is reached.

For the connecting structure of the first embodiment described above, the crimp claws 32*b* of the terminal 30 are crimped to the spacer member 40 which is overlaid on the conductor exposed portion 13 of the flat circuit body 10, and by pressing the spacer member 40 to the side of the bottom plate 32*a* of the terminal 30, to make the flat conductor 11 in the conductor exposed portion 13 closely contact with the bottom plate 32*a* of the terminal 30 in a surface contact state, a crimped state of the flat conductor 11 of the flat circuit body 10 and the terminal 30 is reached. That is, the crimp claws 32*b* of the terminal 30 will not penetrate through the flat conductor 11 of the flat circuit body 10, and since the distal ends of the claws do not cut into the flat conductor 11, the crimp claws 32*b* will not damage the flat conductor 11.

Therefore, even if a pulling load is acted on the flat circuit body 10, the damage will not expand in the flat conductor 11 as conventionally, and electrical connection performance does not decrease due to the increase of contact resistance with the expansion of the damage in the flat conductor 11.

In addition, in the construction that the crimp claws 32*b* press the flat conductor 11 of the conductor exposed portion 13 to the bottom plate 32*a* of the terminal 30 through the spacer member 40, since the crimp claws 32*b* do not directly contact with the conductor exposed portion 13, the force increasing or decreasing which is difficult in a crimping operation of the terminal 30 is not required. Therefore, the crimping operation can be performed easily.

Therefore, a stable electrical connection performance can be easily secured.

In the connecting structure of the first embodiment described above, when a crimper which makes the crimp claws 32*b* to be curved from the distal end side to make the distal ends of the crimp claws 32*b* abut on the top surface of the spacer member 40 is used as a means for crimping the crimp claws 32*b* to the spacer member 40, the projected parts 42 which are deformed plastically to a shape corresponding to the shape of the inner surfaces of the crimp claws 32*b* by a pressure applied from the crimp claws 32*b* are buried in spaces which the curved crimp claws 32*b* form.

In other words, the crimp claws 32*b* contact with the projected parts 42 without a gap so that the spacer member 40 is pressed and fixed tightly by the crimp claws 32*b*. Thus, because the pressing force applied from the crimp claws 32*b* to the projected parts 42 is acted on the flat board-like conductor pressing part 41, roughly the whole area of the flat conductor 11 closely contacts with the bottom plate 32*a* roughly equally in a surface contact state. Therefore, an enough contact area, where the contact pressure between the terminal and the flat conductor 11 is stabilized, is secured so that a reliable electrical connection performance can be obtained.

Further, by performing the previously described steps in the connecting method of the first embodiment described above, the connecting structure of the first embodiment can be formed. Therefore, the electrical connection performance does not decrease when the flat conductor 11 of the flat circuit body 10 is damage by a pulling load acted on the flat circuit body 10, and the force increasing or decreasing which is difficult in a crimping operation of the terminal 30 is not required so that a stable electrical connection performance can be easily secured.

Figure 11:
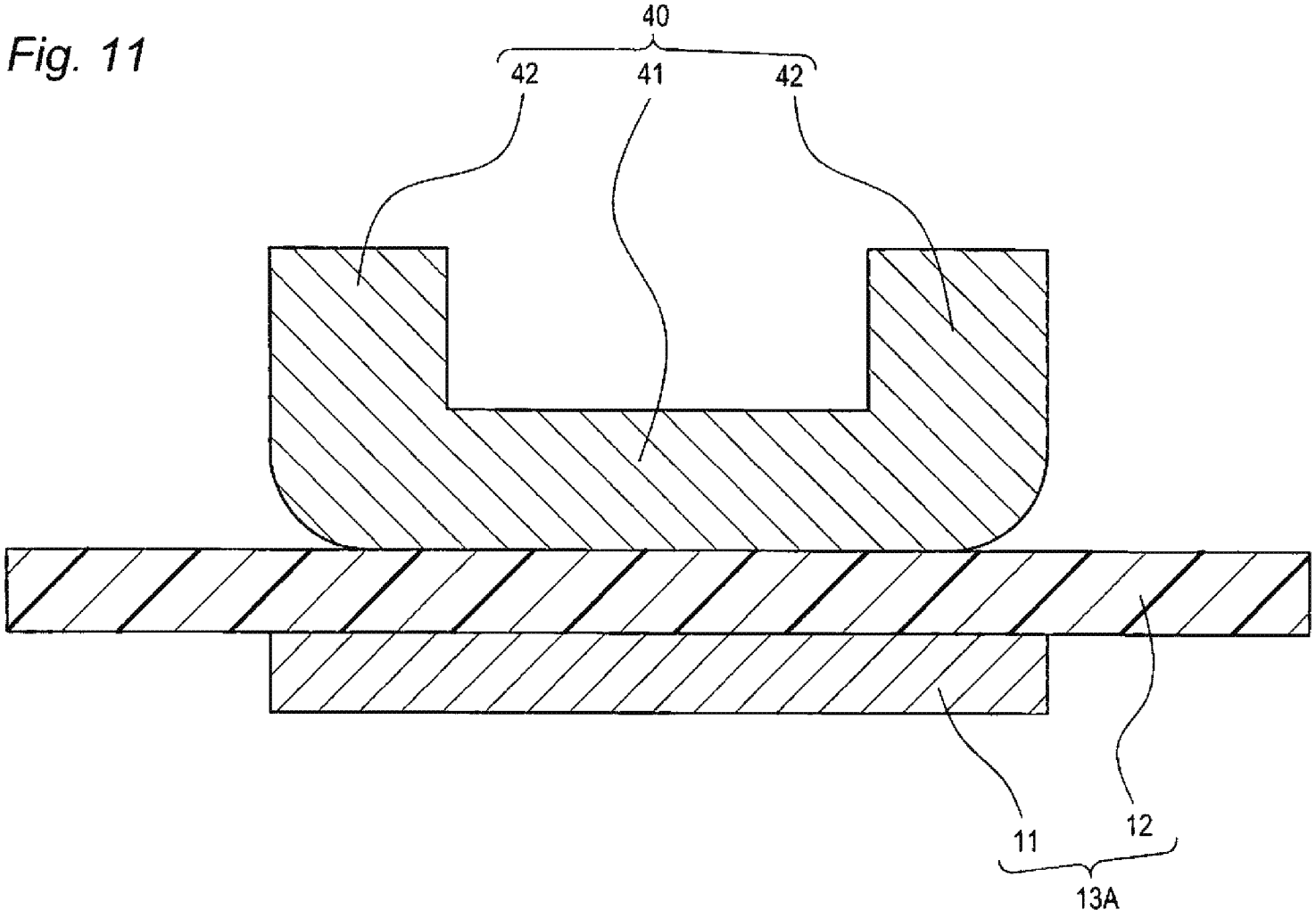
FIG. 11 is a cross sectional view which shows a state that a spacer member is mounted on a conductor exposed portion of FIG. 10.
Figure 12:
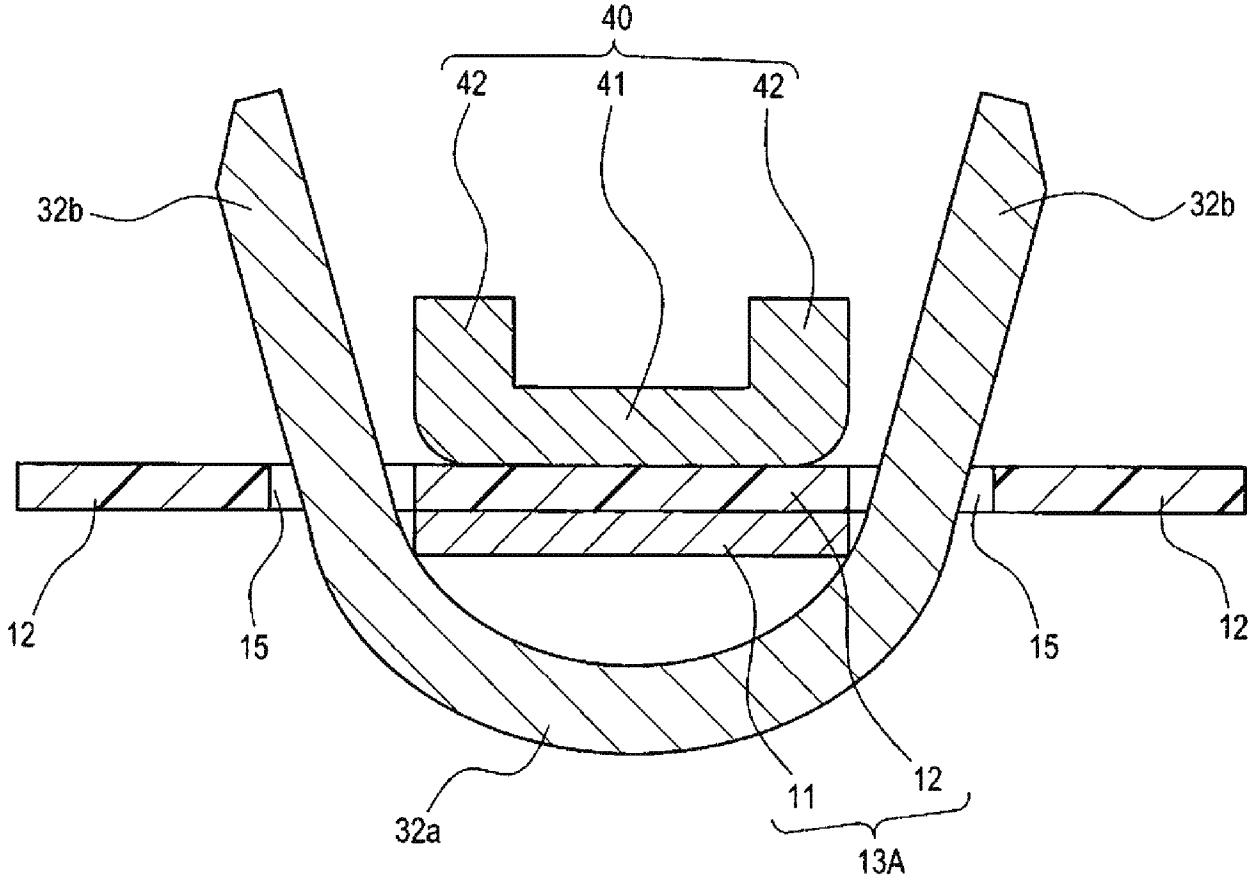
FIG. 12 is a cross sectional view which shows a state that the conductor exposed portion and the spacer member of FIG. 11 are mounted on a bottom plate of the terminal.
Figure 13:
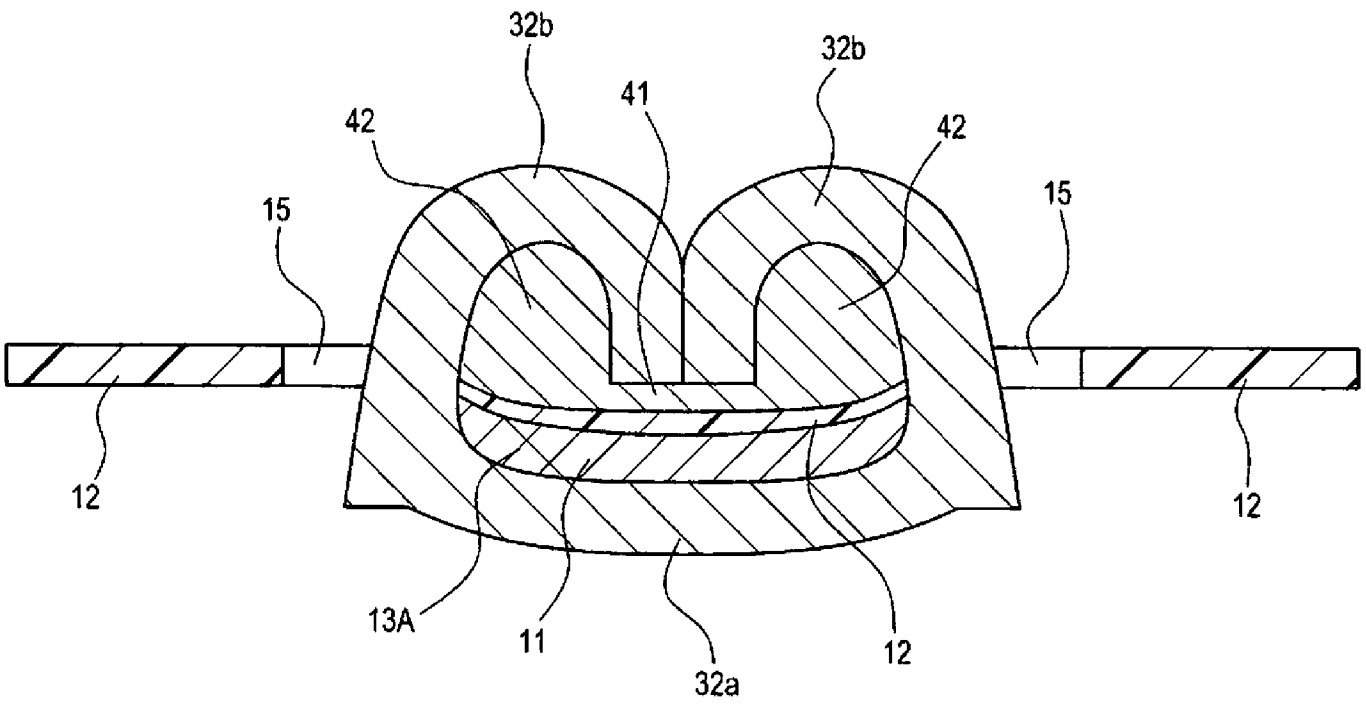
FIG. 13 is a cross sectional view which shows a state that crimp claws of the terminal are crimped to the spacer member shown in FIG. 12.

FIGS. 10 to 13 are figures which show a second embodiment of a connecting structure of a flat circuit body and a terminal according to the present invention. FIG. 10 is a perspective view of the flat circuit body used in the second embodiment of the present invention. FIG. 11 is a cross sectional view which shows a state that a spacer member is mounted on a conductor exposed portion of FIG. 10. FIG. 12 is a cross sectional view which shows a state that the conductor exposed portion and the spacer member of FIG. 11 are mounted on a bottom plate of the terminal. FIG. 13 is a cross sectional view which shows a state that crimp claws of the terminal are crimped to the spacer member shown in FIG. 12.

The flat circuit body 10 in the second embodiment differs from that in the first embodiment in the structure of the conductor exposed portion 13. The conductor exposed portion 13A in the second embodiment has such a structure that the insulating layers 12 on the surfaces at one side of a plurality of flat conductors 11 are stripped to only make the surfaces at one side of the flat conductors 11 exposed.

In the second embodiment, the spacer member 40 which is mounted on the conductor exposed portion 13A, the terminal 30 which is crimped to connect to the conductor exposed portion 13A, and the like may have the same constructions as those of the first embodiment, the same numbers are given to the same constructions as those of the first embodiment, and thus their description is omitted.

In the case of the conductor exposed portion 13A of the second embodiment, since the insulating layers 12 remain on the surfaces at one side of the flat conductors 11, claw through slits 15 through which the crimp claws 32*b* of the terminal 30 can be inserted are formed beforehand in the insulating layers 12 that remain, as shown in FIG. 12. The claw through slits 15 are extended along the side edges of the flat conductors 11.

In the second embodiment, as shown in FIG. 12, the conductor exposed portion 13A is mounted on the bottom plate 32*a* in a direction that the exposed flat conductor 11 is made to meet the bottom plate 32*a* of the terminal 30. Thus, the spacer member 40 is mounted on the insulating layer 12 of the conductor exposed portion 13A. As shown in FIG. 13, by crimping the crimp claws 32*b* on the projected parts 42 at two sides of the spacer member 40, a state is reached that the flat conductor 11 of the conductor exposed portion 13A is crimped to connect the terminal 30.

In the case of the second embodiment, like the first embodiment, there is no fear that the electrical connection performance decreases when the flat conductor 11 of the flat circuit body 10 is damaged by a pulling load acted on the flat circuit body 10, and the force increasing or decreasing which is difficult in a crimping operation of the terminal 30 is not required so that a stable electrical connection performance can be easily secured.

Figure 14:
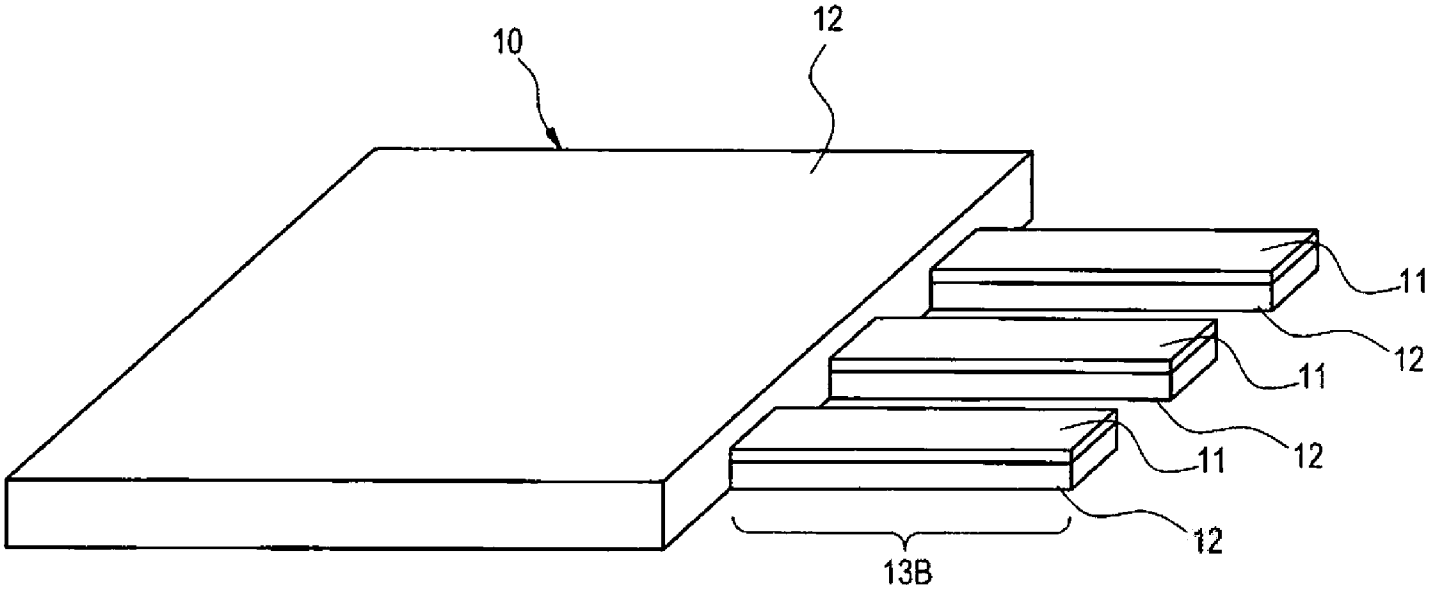
FIG. 14 is a perspective view of a flat circuit body used in a connecting structure of the flat circuit body and a terminal according to a third embodiment of the present invention.
Figure 15:
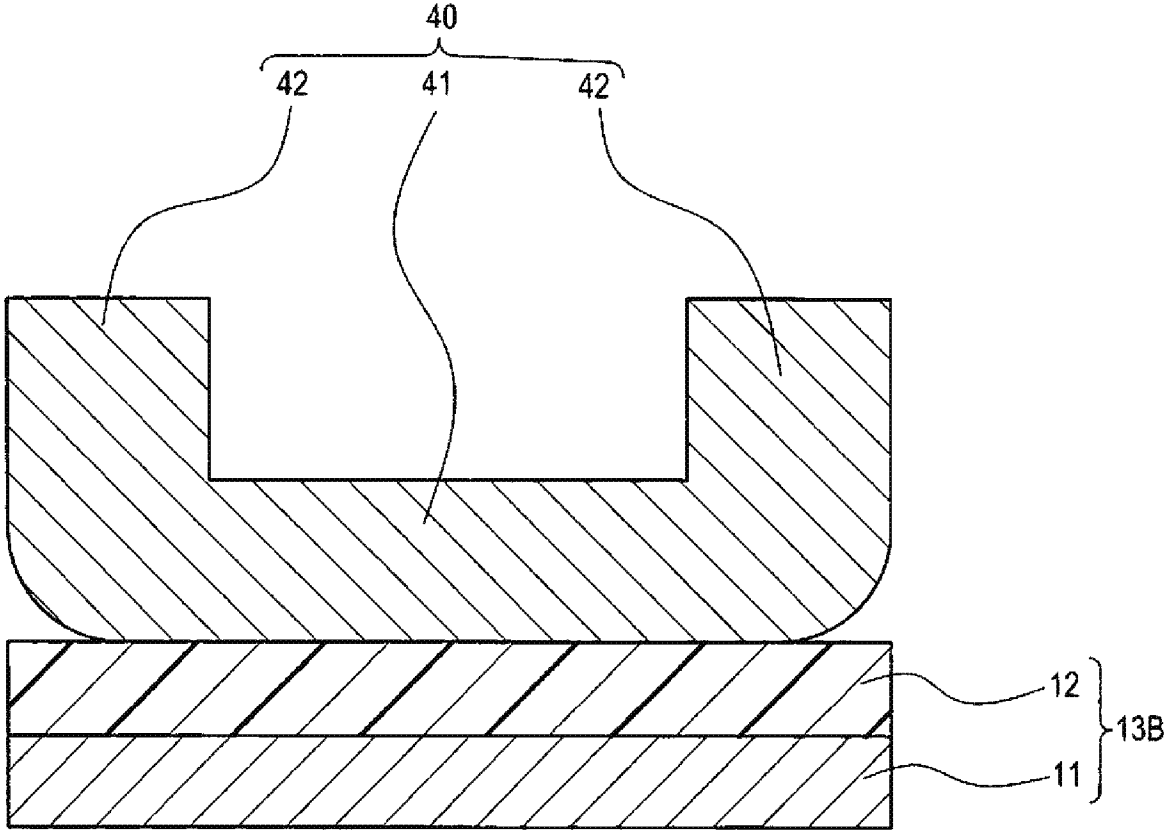
FIG. 15 is a cross sectional view which shows a state that a spacer member is mounted on a conductor exposed portion of FIG. 14.
Figure 16:
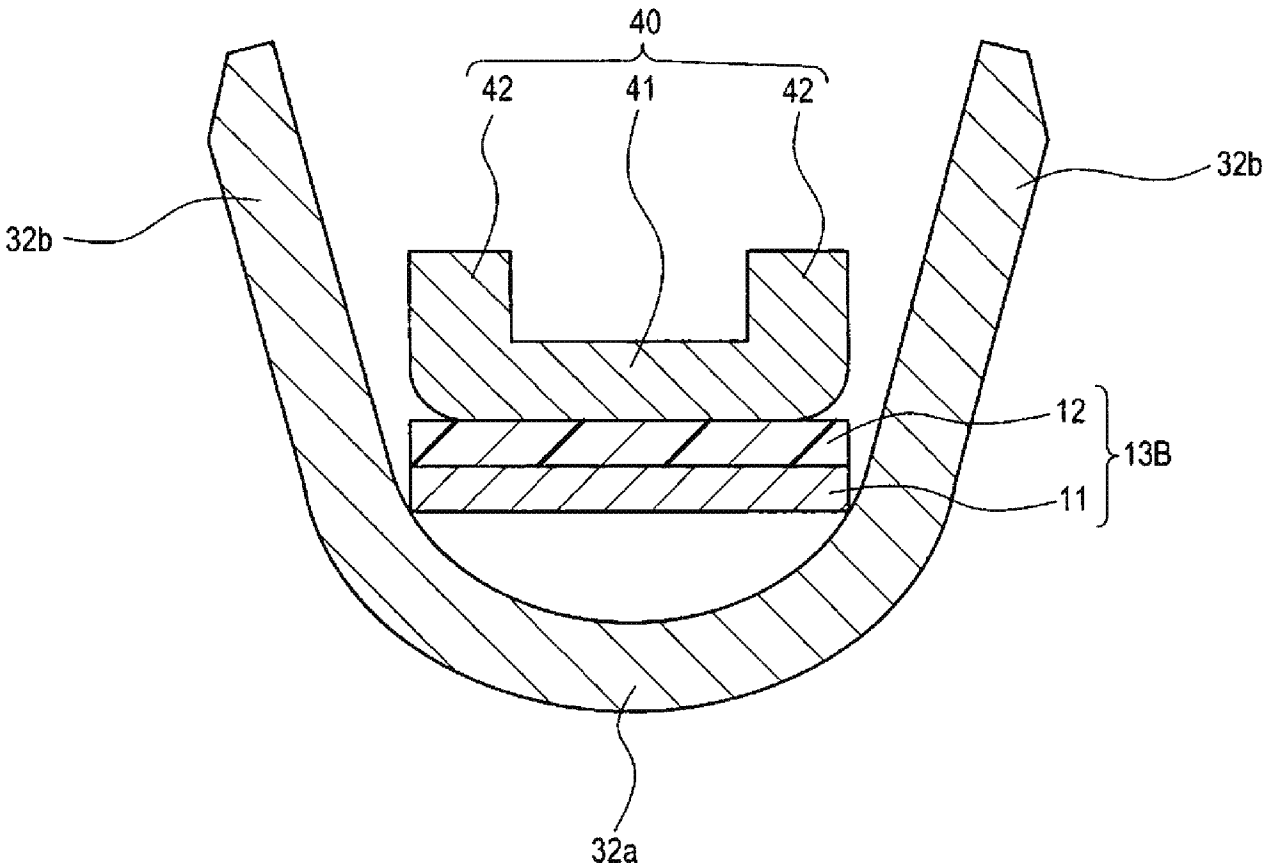
FIG. 16 is a cross sectional view which shows a state that the conductor exposed portion and the spacer member of FIG. 15 are mounted on a bottom plate of the terminal.
Figure 17:
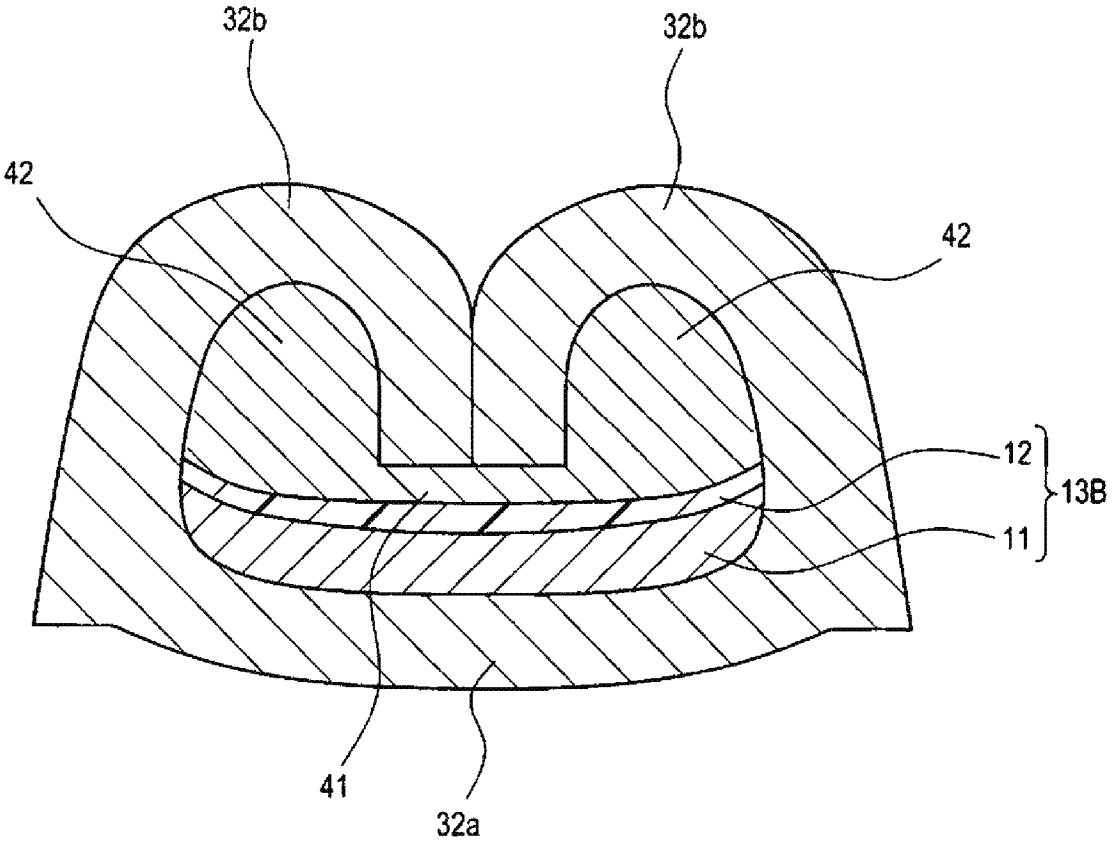
FIG. 17 is a cross sectional view which shows a state that crimp claws of the terminal are crimped to the spacer member shown in FIG. 16.

FIGS. 14 to 17 are figures which show a third embodiment of a connecting structure of a flat circuit body and a terminal according to the present invention. FIG. 14 is a perspective view of the flat circuit body used in the third embodiment of the present invention. FIG. 15 is a cross sectional view which shows a state that a spacer member is mounted on a conductor exposed portion of FIG. 11. FIG. 16 is a cross sectional view which shows a state that the conductor exposed portion and the spacer member of FIG. 15 are mounted on a bottom plate of the terminal. FIG. 17 is a cross sectional view which shows a state that crimp claws of the terminal are crimped to the spacer member shown in FIG. 16.

The third embodiment differs from the second embodiment in a part of the conductor exposed portion 13A, the other constructions may be the same as those of the second embodiment and given the same numbers, and thus their description is omitted.

The difference in a conductor exposed portion 13B of the third embodiment is that the insulating layers 12 between adjacent flat conductors 11 are cut.

In the third embodiment, as shown in FIG. 16, the conductor exposed portion 13B is mounted on the bottom plate 32*a* in a direction that the exposed flat conductor 11 is made to meet the bottom plate 32*a* of the terminal 30. Thus, the spacer member 40 is mounted on the insulating layer 12 of the conductor exposed portion 13B. As shown in FIG. 17, by crimping the crimp claws 32*b* on the projected parts 42 at two sides of the spacer member 40, a state is reached that the flat conductor 11 of the conductor exposed portion 13B is crimped to connect the terminal 30.

In the case of the third embodiment, like the first embodiment, there is no fear that the electrical connection performance decreases when the flat conductor 11 of the flat circuit body 10 is damaged by a pulling load acted on the flat circuit body 10, and the force increasing or decreasing which is difficult in a crimping operation of the terminal 30 is not required so that a stable electrical connection performance can be easily secured.

Figure 18:
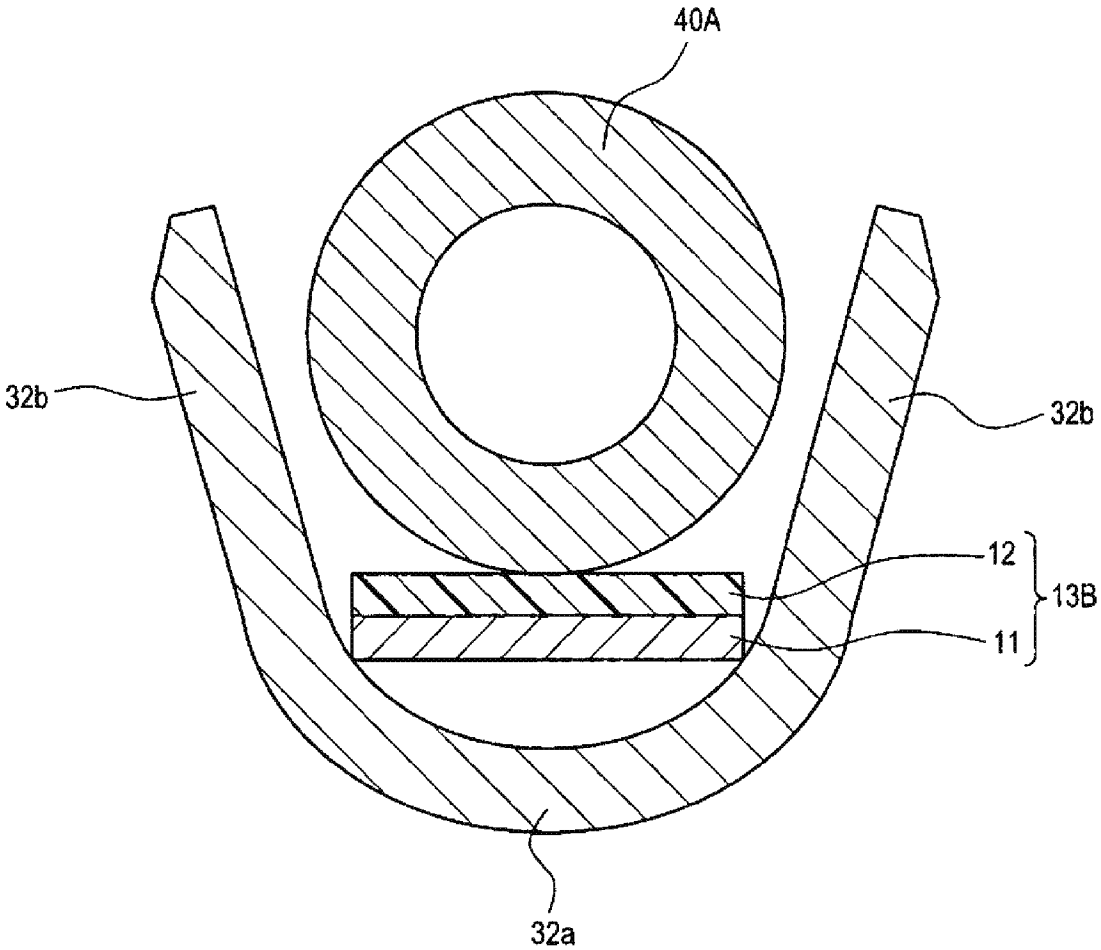
FIG. 18 is a cross sectional view which shows a state that a conductor exposed portion and a spacer member are mounted on a bottom plate of a terminal in a connecting structure of a flat circuit body and the terminal according to a fourth embodiment of the present invention.
Figure 19:
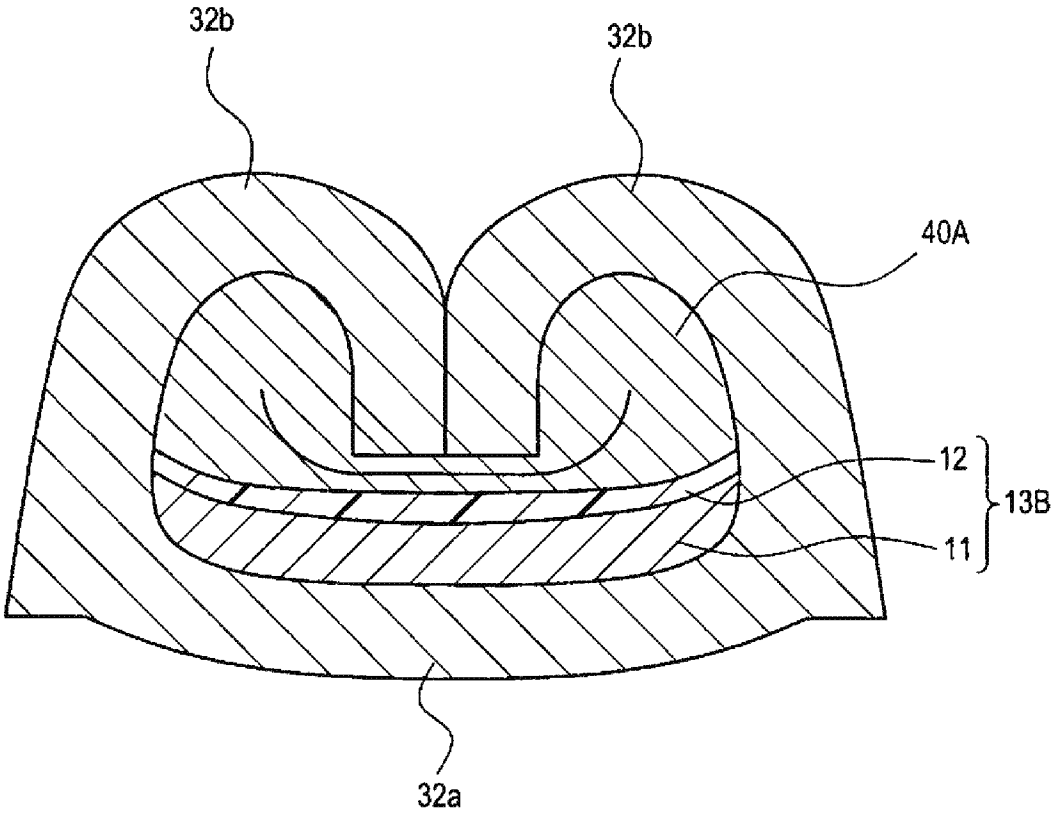
FIG. 19 is a cross sectional view which shows a state that crimp claws of the terminal are crimped to the spacer member shown in FIG. 18.

FIGS. 18 and 19 are figures which show a fourth embodiment of a connecting structure of a flat circuit body and a terminal according to the present invention. FIG. 18 is a cross sectional view which shows a state that the conductor exposed portion shown in FIG. 14 and a spacer member are mounted on a bottom plate of the terminal. FIG. 19 is a cross sectional view which shows a state that crimp claws of the terminal are crimped to the spacer member shown in FIG. 18.

In the fourth embodiment, a tube-like spacer member 40A is mounted on the conductor exposed portion 13B of the third embodiment, and the terminal 30 may have the same construction as that of the third embodiment.

As shown in FIG. 19, when the crimp claws 32*b* are crimped to the circumference of the spacer member 40A, the spacer member 40A is crushed by a pressure applied from the crimp claws 32*b*, to be deformed plastically so that a part of the spacer member 40A closely contacts with the curved inner surfaces of the crimp claws 32*b*.

Figure 20:
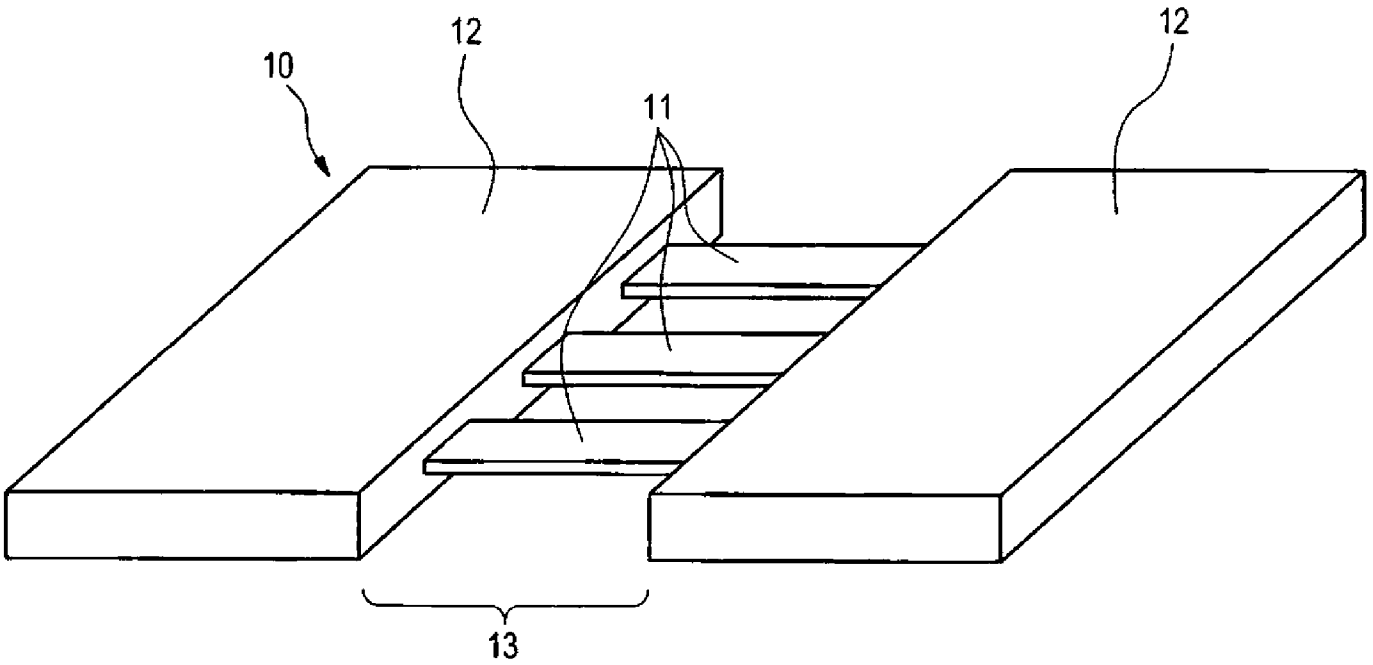
FIG. 20 is a perspective view of a flat circuit body used in a connecting structure of the flat circuit body and a terminal according to a fifth embodiment of the present invention.

FIG. 20 is a perspective view of a flat circuit body used in a fifth embodiment of a connecting structure of the flat circuit body and a terminal according to the present invention.

In the fifth embodiment, a conductor exposed portion 13 where the insulating layers 12 are stripped to expose both surfaces of the flat conductors 11 (like the first embodiment) is formed in a middle part of the flat circuit body 10.

Thus, the position where the conductor exposed portion according to the present invention is formed can be set at the middle part of the flat circuit body 10. In the case of the conductor exposed portion 13 formed in the middle part of the flat circuit body 10 in this way, the exposed flat conductors 11 are folded in the length direction, and the terminals 30 are crimped to connect to the folded part. The terminals 30 may be crimped to connect to the flat conductors 11 without folding the flat conductors 11.

Figure 21:
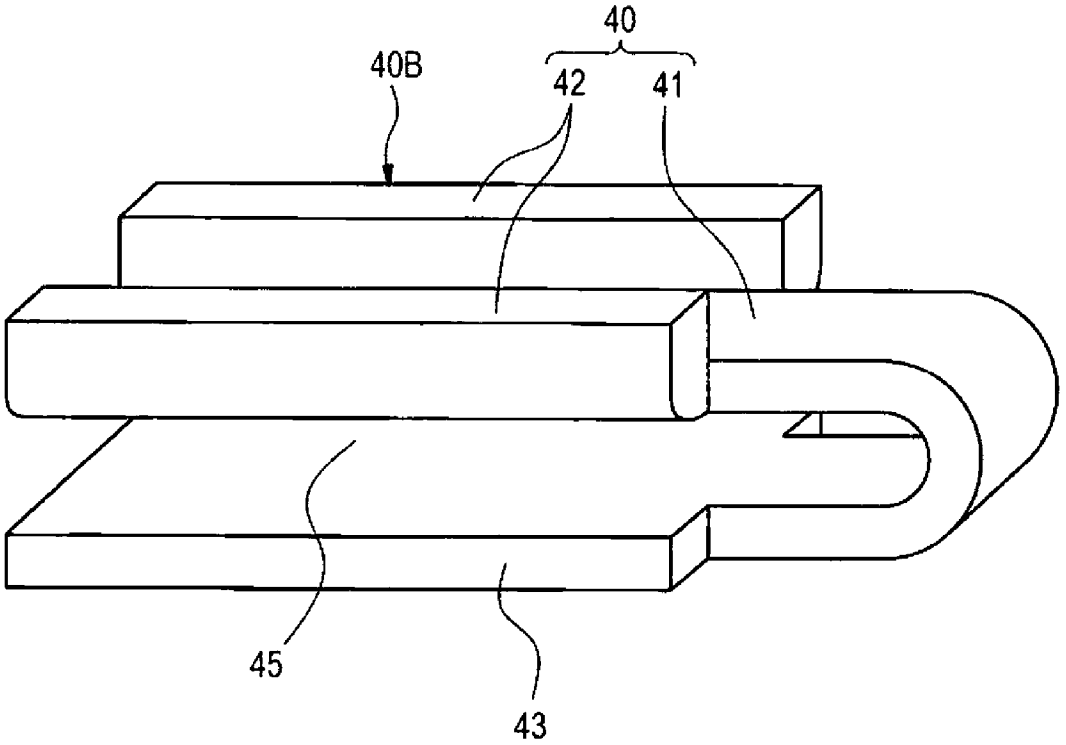
FIG. 21 is a perspective view of a spacer member used in a connecting structure of a flat circuit body and a terminal according to a sixth embodiment of the present invention.
Figure 22:
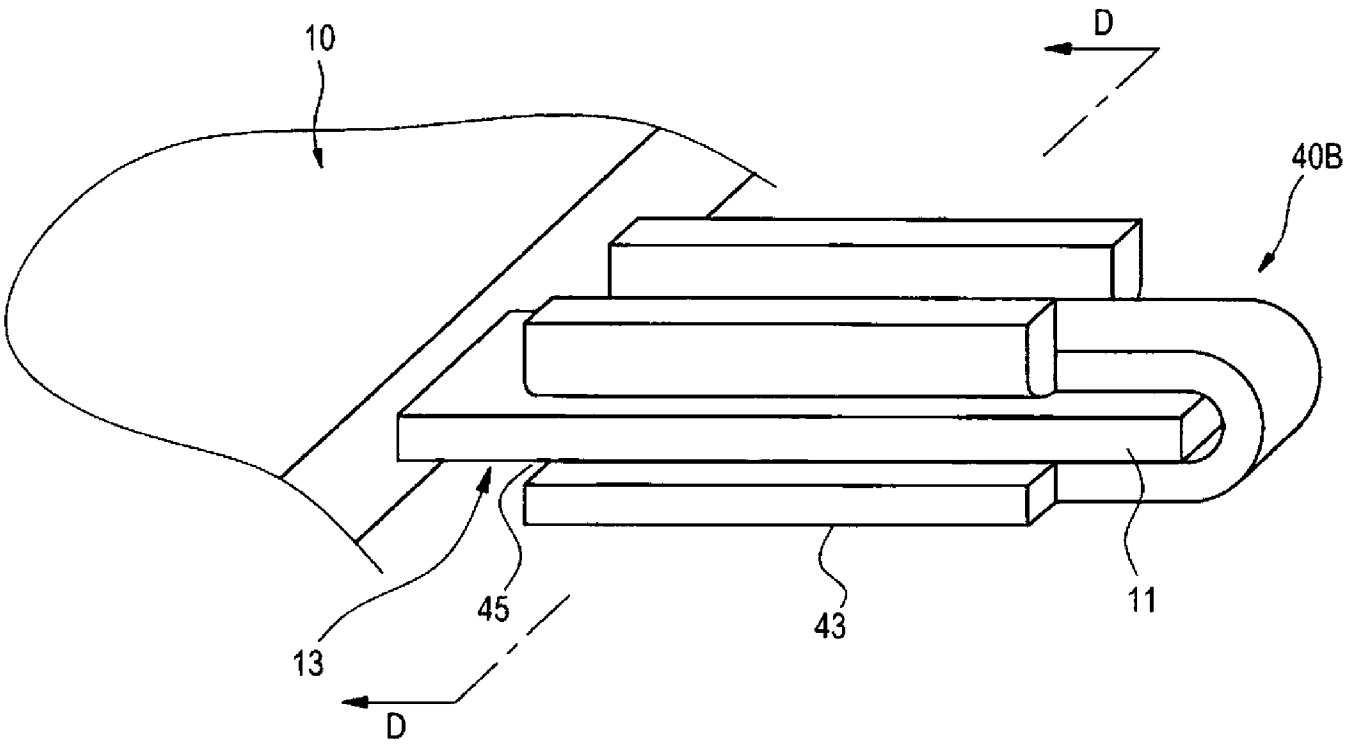
FIG. 22 is a perspective view which shows a state that the spacer member of FIG. 21 is mounted to a conductor exposed portion of the flat circuit body.
Figure 23:
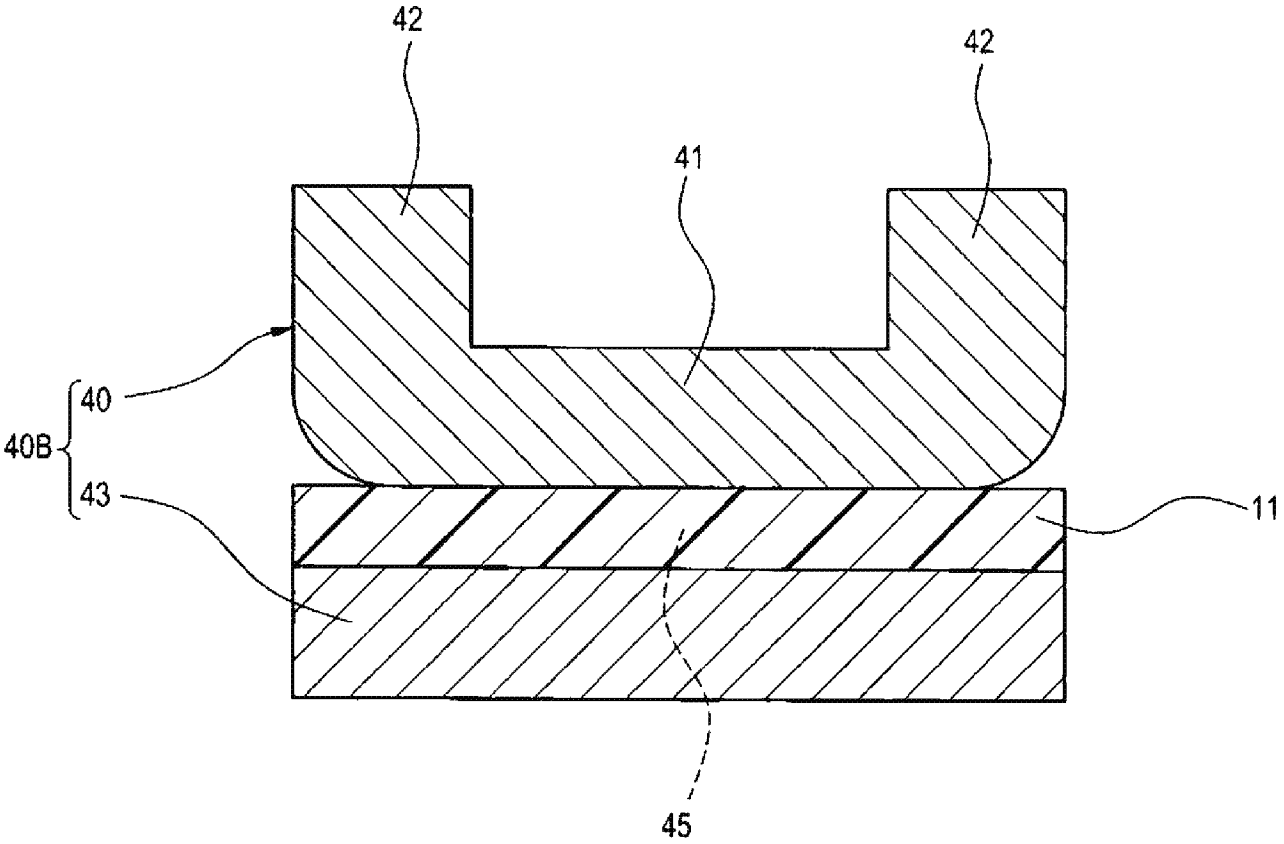
FIG. 23 is a D-D sectional view of FIG. 22.
Figure 24:
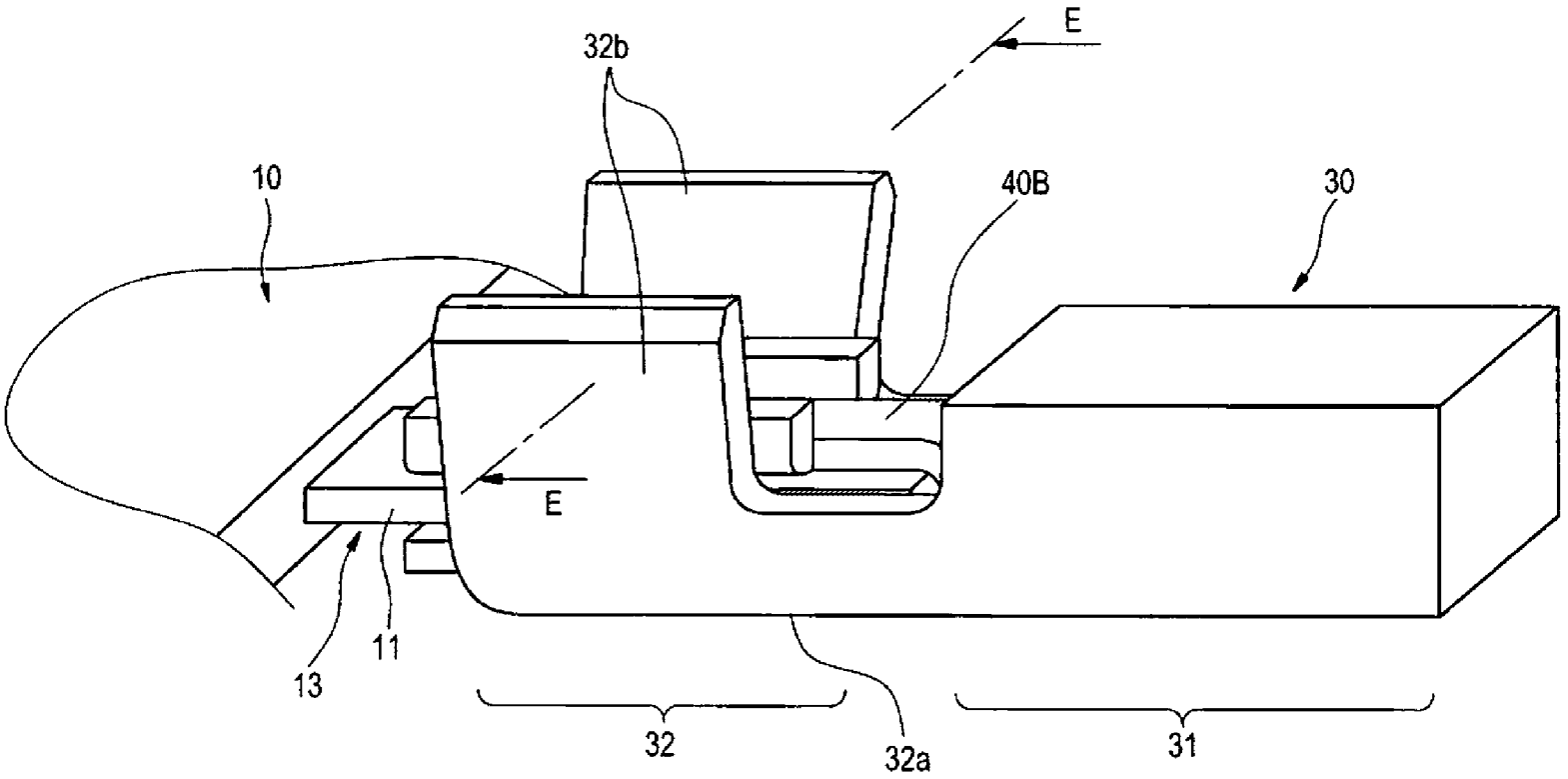
FIG. 24 is a perspective view which shows a state that the conductor exposed portion shown in FIG. 22 is mounted on a bottom plate of the terminal.
Figure 25:
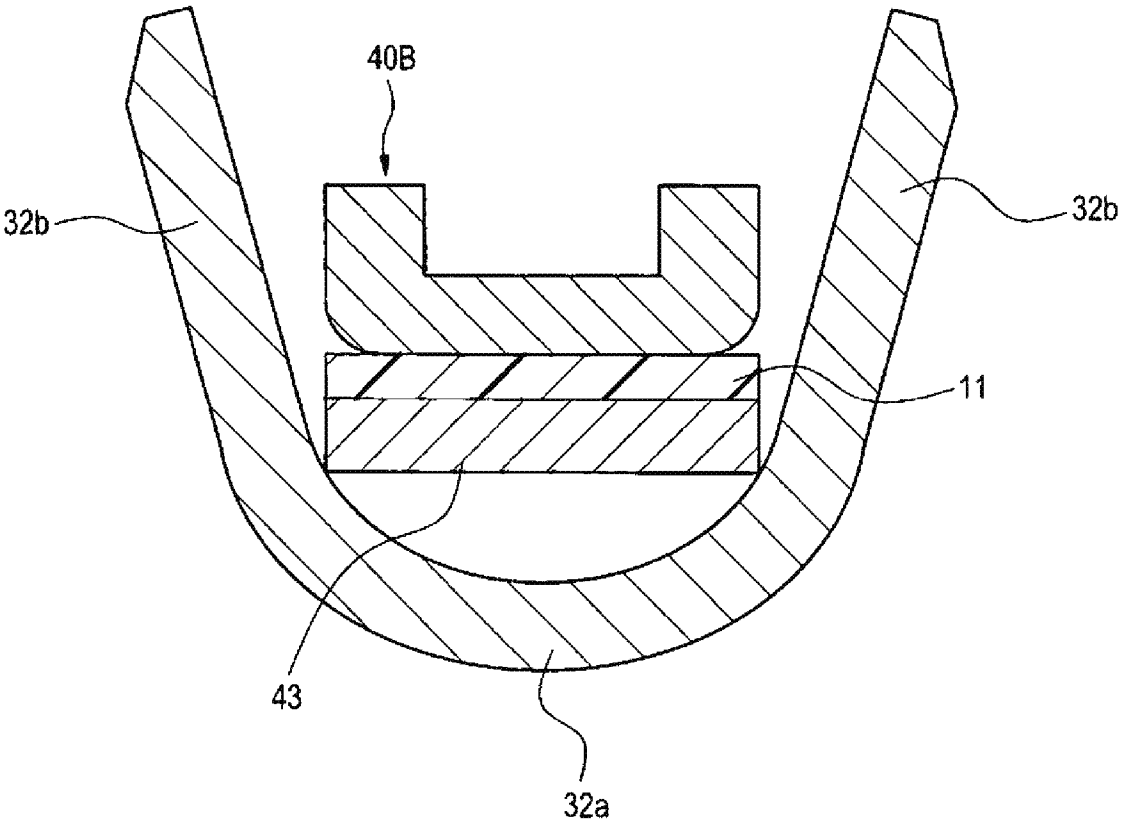
FIG. 25 is an E-E sectional view of FIG. 24.
Figure 26:
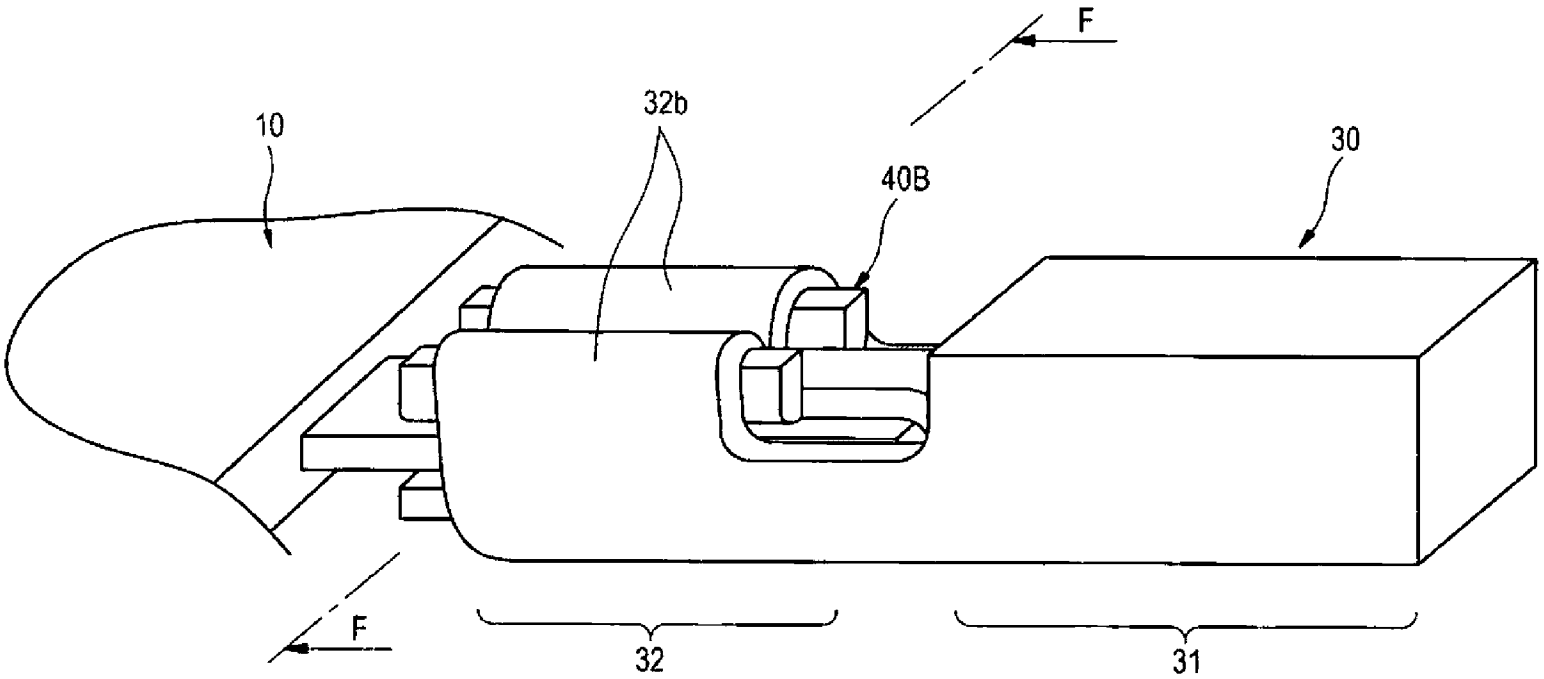
FIG. 26 is a perspective view which shows a completed state that crimp claws of the terminal are crimped to the spacer member shown in FIG. 24.
Figure 27:
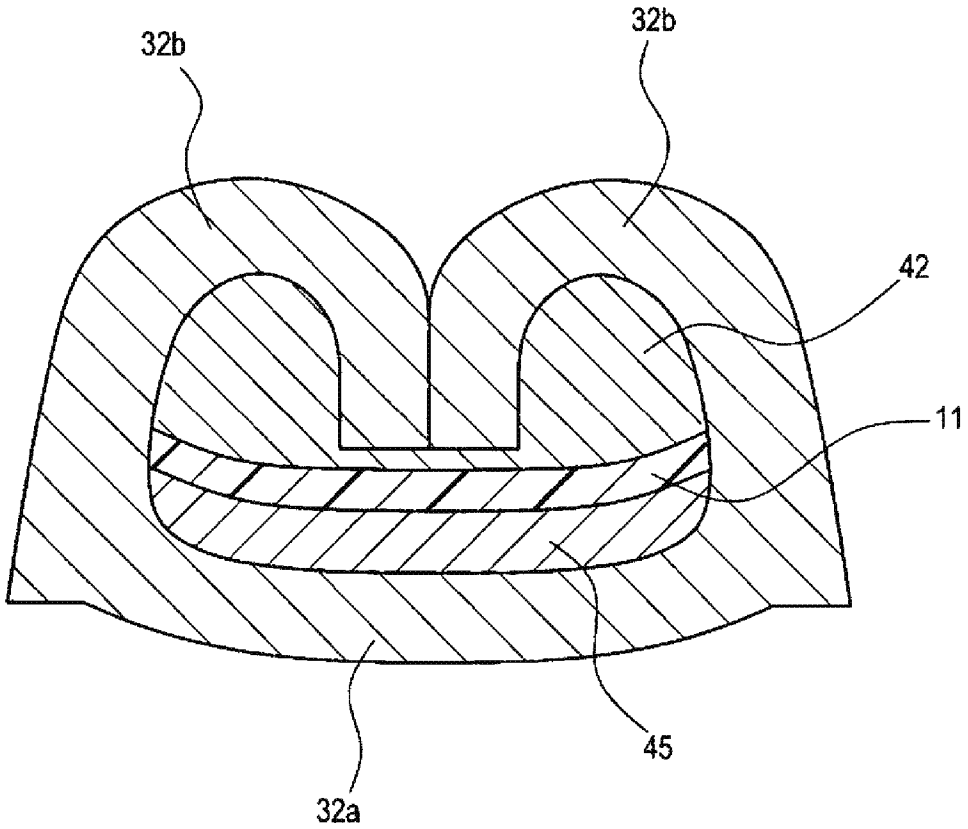
FIG. 27 is an F-F sectional view of FIG. 26.

FIGS. 21 to 27 are figures which show a sixth embodiment of a connecting structure of a flat circuit body and a terminal according to the present invention. FIG. 21 is a perspective view of a spacer member used in the sixth embodiment. FIG. 22 is a perspective view which shows a state that the spacer member of FIG. 21 is mounted to the conductor exposed portion of the flat circuit body shown in FIG. 1. FIG. 23 a D-D sectional view of FIG. 22. FIG. 24 is a perspective view which shows a state that the conductor exposed portion shown in FIG. 22 is mounted on a bottom plate of the terminal. FIG. 25 is an E-E sectional view of FIG. 24. FIG. 26 is a perspective view which shows a completed state that crimp claws of the terminal are crimped to the spacer member shown in FIG. 24. FIG. 27 is an F-F sectional view of FIG. 26.

In the sixth embodiment, a spacer member 40B shown in FIG. 21 is mounted to the conductor exposed portion 13 of the flat circuit body 10 shown in FIG. 1, and the terminal 30 shown in FIG. 2 is crimped to connect to the spacer member 40B.

The spacer member 40B in the sixth embodiment is constructed by additionally equipping the spacer member 40 shown in FIG. 4 with a clamping board 43. The clamping board 43 is formed by folding an extended part of the conductor pressing part 41 to the back side of the conductor pressing part 41. As shown in FIGS. 21 and 22, a clamping space 45 where the flat conductor 11 is clamped is formed inside the conductor pressing part 41. The spacer member 40B is formed integrally of conductive material.

In the sixth embodiment, as shown in FIGS. 22 and 23, by inserting the flat conductor 11 of the conductor exposed portion 13 into the clamping space 45 of the spacer member 40B, the spacer member 40B is mounted to the conductor exposed portion 13. As shown in FIGS. 24 and 25, the spacer member 40B which is mounted to the conductor exposed portion 13 is mounted on the bottom plate 32*a* with the clamping board 43 facing the bottom plate 32*a* of the terminal 30. Then, as shown in FIGS. 26 and 27, by crimping the crimp claws 32*b* on the projected parts 42 of the spacer member 40B, a state is reached that the flat conductor 11 is electrically connected to the bottom plate 32*a* through the clamping board 43.

Figure 28B:
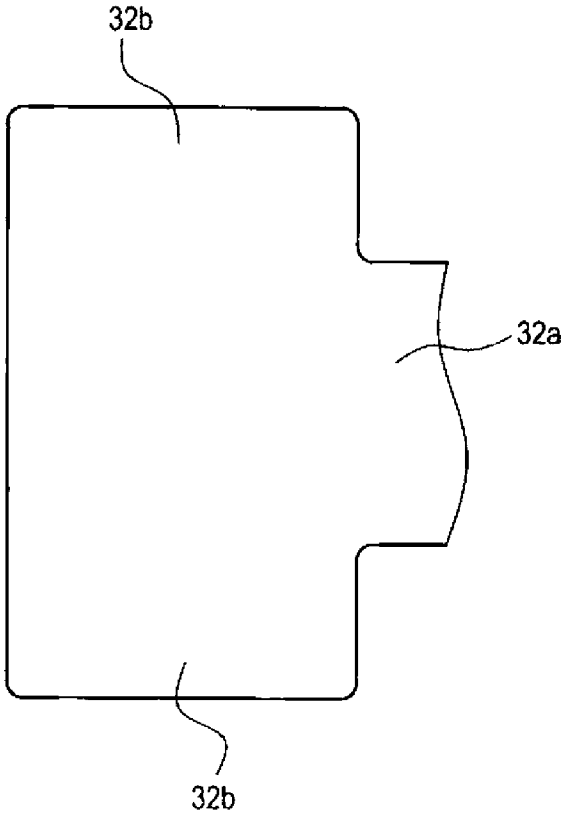
FIG. 28B is an expanded view of a circuit body connecting part of the terminal whose surface is smooth.
Figure 28A:
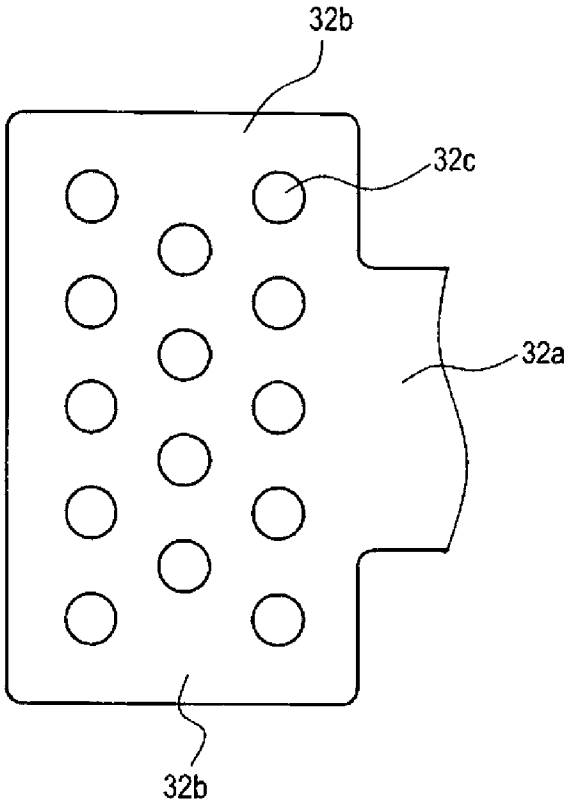
FIG. 28A is an expanded view of a circuit body connecting part of the terminal in which circular serrations are formed.
Figure 29:
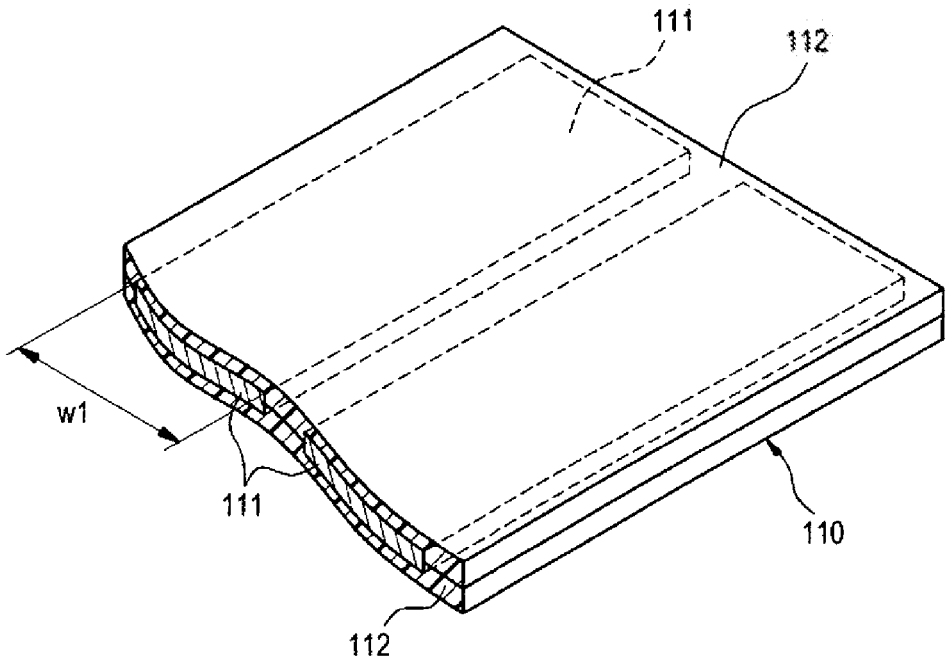
FIG. 29 is a perspective view of a flat circuit body and a terminal which are crimped to connect with a conventional connecting method.
Figure 29:
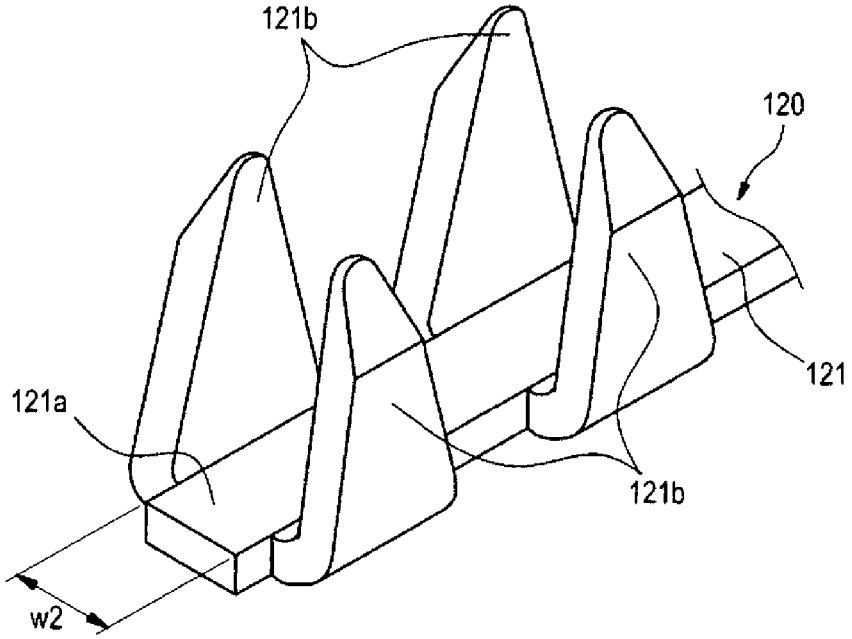

In the connecting structures and the connecting methods of the present invention, the shape of the serrations which are formed on the inner surface of the bottom plate 32*a* and the crimp claws 32*b* in the circuit body connecting part 32 of the terminal 30 is not limited to that shown in FIG. 3. The serrations 32*c* that are formed on the inner surface of the bottom plate 32*a* and the crimp claws 32*b* may be circular recesses as shown in FIG. 28A. As shown in FIG. 28B, the inner surface of the bottom plate 32*a* and the crimp claws 32*b* may be a flat smooth surface on which the serrations are not formed.

In the above-mentioned embodiments, the spacer member is a separate member from the terminal, but the terminal may be integrally equipped with the spacer member.

According to the present invention, there is provided a connecting structure and a connecting method of a flat circuit body and a terminal so that the electrical connection performance does not decrease because the flat conductors of the flat circuit body are damaged by a pulling load that is acted on the flat circuit body, and a stable electrical connection performance can be easily secured without requiring the force increasing or decreasing which is difficult in a crimping operation of the terminal.

What is claimed is:

1. A connecting structure of a flat circuit body and a terminal, comprising:

a flat circuit body including a flat conductor and an insulating layer covering at least one surface of the flat conductor, a portion of the flat conductor being exposed from the insulating layer;

the terminal including a bottom plate on which the exposed portion of the flat conductor is provided, and crimp claws which are raised at two side edges of the bottom plate so that the exposed portion of the flat conductor is disposed therebetween; and a spacer member provided on the exposed portion of the flat conductor, the spacer member including a flat portion having a first edge and a second, opposite edge and two distinct projected parts, each projected part of the two distinct projected parts extending outward from one of the first edge and the opposite second edge, and the spacer member being configured to be plastically deformed to contact with inner surfaces of the crimp claws when the crimp claws are crimped onto the spacer member, thereby the terminal is crimped to the flat conductor in a state where the exposed portion of the flat conductor is in surface contact with the bottom plate.

2. The connecting structure according to claim 1, wherein the flat circuit body includes a plurality of flat conductors which are arranged in a planar shape and are separated at a predetermined interval.

3. The connecting structure according to claim 1, wherein the flat portion of the spacer member includes a conductor pressing part which is provided on the exposed portion of the flat conductor and the two distinct projected parts extend outward from the conductor pressing part, and the two distinct projected parts are covered by the crimp claws and are plastically deformed so as to contact with the inner surfaces of the crimp claws, when the crimp claws are crimped onto the spacer member.

4. The connecting structure of claim 1, the crimp claws further including:

a first crimp claw having an interior surface facing the spacer member in an uncrimped configuration and an opposite, exterior surface; and a second crimp claw having an interior surface facing the spacer member in the uncrimped configuration and an opposite exterior surface, and wherein when the crimp claws are crimped onto the spacer member, each crimp claw extends around one of the two distinct projected parts and at least a portion of the exterior surface of the first crimp claw is in contact with at least a portion of the exterior surface of the second crimp claw.

* * * * *